US006035168A

United States Patent [19]

Masuda et al.

[11] Patent Number: 6,035,168

[45] Date of Patent: Mar. 7, 2000

[54] DEVELOPING DEVICE HAVING A REDUCED WIDTH IN THE HORIZONTAL DIRECTION

[75] Inventors: Jitsuo Masuda, Yamatotakada; Hiroshi Kawamoto, Tenri; Makoto Uehara, Yamatokoriyama; Yasutaka Maeda; Takeshi Wakabayashi, both of Kyoto; Takahiko Kimura, Ikoma; Tao Ou, Yamatokoriyama; Naotaka Funayama, Tenri; Toshio Nishino, Yamatokoriyama; Yasuyuki Ishiguro, Higashiosaka; Syouichi Fujita, Kashiba; Hirofumi Sakita, Tenri, all of Japan

[73] Assignee: Sharp Kabushiki Kaisha, Osaka, Japan

[21] Appl. No.: 09/223,370

[22] Filed: Dec. 30, 1998

[30] Foreign Application Priority Data

Jan. 9, 1998 [JP] Japan ..... 10-002923
Jun. 9, 1998 [JP] Japan ..... 10-160367

[51] Int. Cl.[7] ..... G03G 15/08

[52] U.S. Cl. ..... 399/254; 399/272

[58] Field of Search ..... 399/254, 256, 399/258, 260, 262, 272, 273, 274, 281, 283, 284; 430/120, 122; 222/167, DIG. 1

[56] References Cited

U.S. PATENT DOCUMENTS 4,112,870 9/1978 Extra et al. ..... 399/272 X
4,777,512 10/1988 Takahashi et al. ..... 399/254 X
4,913,087 4/1990 Saita et al. ..... 399/12
4,940,014 7/1990 Saijo et al. ..... 399/256
5,722,002 2/1998 Kikuta et al. ..... 399/256 X

FOREIGN PATENT DOCUMENTS 2-64583 3/1990 Japan .
4-066985 3/1992 Japan .
4-121764 3/1992 Japan .

*Primary Examiner*—Sophia S. Chen

[57] ABSTRACT

A developing device having a reduced size in the horizontal direction and in which a developing agent is transported with stirring along a circulating route inside a developing tank to effectively mix newly added toner therewith and stir the mixture. A developing tank for storing developing agent therein is horizontally divided with a partition member thereby providing an upper chamber and a lower chamber. A developer roller and a stirring roller are disposed in the lower chamber. Two screw rollers are disposed in the upper chamber. An inlet opening is formed between an end of the partition member and a regulating member for restricting a layer if the developing agent adsorbed to the developing roller. A developing agent removed by the restricting member is fed through an inlet opening to the screw rollers in the upper chamber. The developing agent is mixed with fresh toner supplied through a supply inlet and transported with being stirred by the screw roller in its axial direction. Then, the developing agent is transferred to the screw roller disposed parallel to the screw roller and it is further transported and returned to the stirring roller in the lower chamber through a return port provided opposite to the screw roller. The compact construction of the developing device is realized by arranging screw rollers for stirring and transporting toner in the upper chamber.

12 Claims, 13 Drawing Sheets

DEVELOPING DEVICE HAVING A REDUCED WIDTH IN THE HORIZONTAL DIRECTION

BACKGROUND OF THE INVENTION

The present invention relates to a toner image developing device for developing a latent image formed on an image carrying body with a color toner.

An image-forming device such as a copier or a printer employing electrophotographic method is usually provided with a conventional developing device for developing a latent image formed on a light-sensitive surface of an image carrier with color toner transferred thereto to visualize the image.

In the conventional developing device, a latent image formed on the light-sensitive drum and developed with toner thereon is transferred onto a sheet of printing material. After this, toner particles remaining on the surface of the light-sensitive drum are removed off before starting a subsequent process of forming a latent image thereon. For this purpose, a cleaning device is provided for cleaning off unused toner remaining on the light-sensitive drum after transferring the developed toner-image therefrom onto the printing material. The removed toner particle is collected in a toner collecting portion of the cleaning device.

The developing device is provided with a developer roller for transporting a developing agent composed of toner particles and magnetic carrier particles to a developing area opposing to the light-sensitive drum by using magnetic force. A developing agent remaining unused after developing a latent image is returned into the developing chamber. The developer roller is supplied with fresh developing agent instead of a collected agent to obtain high-quality of toner-developed images. This stabilizes the latent image developing process so that a sufficient visual image can be always obtained.

A developing agent remaining on the developer roller after developing a latent image is separated by using a magnet disposed in a non-magnetic cylindrical sleeve. This magnet has an odd number of magnetic poles, neighbors of which are of the same polarity at an area for removing a developing agent from the developer roller after developing a latent image. This realizes that a developing agent can naturally fall down from the developer roller.

In the above-mentioned developing device, the developer roller is disposed opposite to the light-sensitive drum to visualize a latent electrostatic image formed the light-sensitive drum. FIG. 1 schematically shows an exemplified construction of the developing device. As seen in FIG. 1, a developing chamber 101 containing a developing agent composed of toner particles and carrier particles is provided with a developer roller 102 rotatably mounted therein at an opening portion opposite to a light-sensitive drum (not shown). The developer roller 102 is partly sticking out through the opening of the developing chamber 101 and is disposed at a specified space (gap) from the light-sensitive drum (not shown).

The developer roller 102 consists of a rotary cylindrical sleeve 102*a* made of non-magnetic material containing a magnet roller 102*b* having the odd-number of magnetic poles. The magnetic roller 102 is disposed so that its main developing magnetic pole N1 is opposite at a specified gap to the light-sensitive body.

No adsorption of the developing agent occurs between magnetic poles S2 and S3 of the magnet roller 102*b*.

Therefore, developing agent falls off the corresponding area surface of the sleeve 102*a*. A stirrer roller 103 is disposed opposite to the above-mentioned area of the sleeve 102*a*. This stirrer roller 103 is provided for mixing a developing agent and transporting the mixed agent to the position of a suction magnetic pole S3 of the magnet roller 102*b*. The developing agent is adsorbed to the surface of the sleeve 102*a* and further transported by rotation of the sleeve 102*a*.

Thus, the sleeve 102*a* with a developing agent adhered to its surface by the magnetic force of the magnet roller disposed therein rotates in the direction indicated by an arrow in FIG. 1. Namely, the sleeve 102*a* rotates to transport a developing agent sucked by the magnetic pole S3 onto the sleeve surface and further adhered thereto by the attracting force of the so-called transporting magnetic poles N2 and S1 of the magnet roller 102*b*. A doctor plate 104 is disposed opposite to the rotating sleeve 102 within the area between the magnetic poles N2 and S1 therein to restrict thickness of developing agent layer adhering to the rotating sleeve. The developing agent is further transported to an area of the developing magnetic pole N1 and is magnetically excited (like a magnetic brush) to be in contact with the surface of rotating light-sensitive drum. The latent image formed thereon is thus developed.

At the upstream side of the developing roller, there are disposed two screw rollers 105 and 106 for feeding toner particles in the direction of its rotation axis to a stirrer roller 103. These screw rollers 105 and 106 are arranged in parallel to the developer roller 102 and the stirrer roller 103 in horizontal direction.

As shown in FIG. 2, the toner feeding screw rollers 105 and 106 have a parallel rotation axis and are driven into rotation in reverse directions to each other. Toner is fed from a supply inlet 107 (as indicated by an arrow P) to one end of the screw roller 105 by which the particles are transported in the direction shown by an arrow (leftward in FIG. 2) and transferred to the screw roller 106. The particles are then fed by the screw roller 106 to the stirrer roller 103 disposed in parallel to the screw roller 106.

The thus constructed developing device is disclosed for example in Japanese Laid-Open Patent Publication No. 2-64583. The developing device of this type is very small to be adapted for manufacturing a thin copier or printer. This is particularly adapted to dispose a plurality of developing devices containing toners of different colors (e.g., yellow, magenta, cyan and black) respectively in layers in respect to a light-sensitive drum.

The developing device shown in FIGS. 1 and 2 has an advantageous thin design achieved by horizontal arrangement of the stirrer roller 103 for stirring a developing agent, the developer roller 102 and the transporting screw rollers 105 and 106 for feeding toner in a tank.

In recent years, a rapid advance has been made in digital and multicolor image forming apparatuses such as copiers, printers and facsimiles. In particular, a variety of image forming methods have been proposed for color image-forming apparatuses.

A typical arrangement is such that four developing devices as described before are disposed one above another around a light-sensitive drum to repeat four developing cycles for forming a color image. For this purpose, the arrangement of four developing devices of FIG. 1 may effectively prevent the image-forming apparatus being increased in height. However, the developing process must be separately performed four times, resulting in reduction of copying speed of the apparatus.

Such a tandem color-image forming method has been proposed with four light-sensitive drums which are arranged parallel to one another, and four different color images which are formed thereon, developed with respective color toners and transferred onto an intermediate transfer drum or directly onto a copy sheet. This method can obtain four-color toner-developed images at the same time, thereby achieving four-times higher copying speed as compared with the before-described method. In this regard, the tandem method is very advantageous color-image forming method.

The tandem method of forming a color image requires parallel arrangement of light-sensitive drums for forming respective color images and respective processing means including developing devices. If the developing devices of FIG. 1 are provided in parallel for respective light-sensitive drums, they have an increased size in the horizontal direction. In the tandem system in particular, it is desired to increase the copying speed by shortening the distance of transporting a recording sheet, which may be realized by arranging the light-sensitive drums at a least interval between them. This requirement cannot be satisfied by the developing devices of FIG. 1.

The developing device of FIG. 1 is provided with only one stirrer roller 103 which cannot achieve high efficiency of mixing toner particles with a developing agent and, therefore, cannot be adapted to a high-speed developing process. The use of plural stirrer rollers 103, however, increases the horizontal length (i.e., the width) of the developing device.

SUMMARY OF THE INVENTION

A primary object of the present invention is to provide a compact developing device having a reduced width in the horizontal direction with no deterioration of its properties.

Another object of the present invention is to provide a developing device optimally adapted to use in a tandem type color-image forming apparatus, such device can be mounted in parallel to each other at a least distance therebetween.

Another object of the present invention is to provide a developing device which can achieve stabilized development of an image with toner through performing effective stirring and circulation of a developing agent and smooth movement of the developing agent with a minimized residence time.

Another object of the present invention is to provide a developing device, which comprises a developing tank containing a developer roller for transferring, by electrically adsorption, developing agent consisting of toner particles and carrier particles, wherein said tank is divided by a partition into a lower developing chamber containing the developing roller and an upper stirring chamber provided with means for stirring a developing agent therein: a regulating member for limiting a feed amount of a developing agent to be adsorbed by the developer roller and the tip of the partition member forms an inlet opening through which a developing agent removed by the regulating member is fed into the upper chamber, and the partition has a return port formed therein for circularly returning the developing agent from the upper stirring chamber into the lower developing chamber.

In the developing device, developing agent restricted in amount by a doctor plate is fed to the upper stirring chamber wherein the agent is transported being stirred to the developing roller for adsorbing the agent thereto. The stirred developing agent is returned through a return port into the lower developing chamber wherein the developer roller is disposed. Thus a restricted flow of the developing agent is circulated in a circulation route from the developing chamber to the stirring chamber and then to the developing chamber again. The developing agent is so sufficiently stirred that toner particles fed for compensation may be well mixed with the agent and stirred to an even concentration assuring the high quality of development of an image with the agent. The arrangement of the stirring chamber above the developing chamber reduces horizontal width of the developing device.

Another object of the present invention is to provide a developing device having the same construction as described above and further characterized in that the upper stirring chamber has a filling port at one end for receiving compensating toner particles to be mixed with the developing agent being restricted in amount by the regulating means and contains a first transporting means for transporting the developing agent from the inlet end side to the opposite end side and second transporting means for transporting developing agent in the reverse direction, both transporting means are disposed in parallel and separated by a baffle plate having cut holes formed therein for allowing circulation of developing agent in the housing. This construction allows toner particles for compensation to be sufficiently mixed with a regulated flow of the developing agent preventing partial increase of the toner concentration. The developing agent can be thus sufficiently stirred and electrostatically charged to efficiently develop an image without fogging. In this instance, there is no need for providing a plurality of stirring means in the developing chamber, thus realizing a further compact device. The baffle plate has a passage at its center portion, by the effect of which the developing agent can be evenly returned in the axial direction of the developer roller without pushing-out of a part of the developing agent into the developing chamber.

Another object of the present invention is to provide a developing device having the same construction as described above and further characterized in that the baffle plate has passing holes by ones at its center and both end portions and corresponding return ports are provided at the corresponding separate portions of the second transporting means. This enables the developing agent to be returned more evenly in the axial direction without partial concentration of the agent.

Another object of the present invention is to provide a developing device having the same construction as described above and further characterized in that the concentration of toner particles mixed by stirring with the developing agent, is measured by a toner concentration sensor disposed at the bottom of the developing chamber just after the stirred developing agent passed through the passing hole made in the center of the baffle plate. This makes it possible to promptly detect whether toner concentration in the developing agent is restored after it is compensated with fresh toner particles. The correct toner concentration can also be measured by the sensor because the agent is sufficiently stirred until it reaches to the sensor.

Another object of the present invention is to provide a developing device having the same construction as described above and further characterized in that a toner inlet portion at one end of the first transporting means and the second transporting means are separated by a baffle plate with no passage in the corresponding end area, thus preventing compensatory toner particles from being returned when not-stirred together with the developing agent into the developing chamber. This can eliminate the possibility of deterioration of a developed image due to the use of a partly concentrated developing agent. In other words, the compensatory toner is surely transported from the first transporting means and the second transporting means and then returned into the developing chamber.

Another object of the present invention is to provide a developing device having the same construction as described above and further characterized in that the first transporting means is provided on the toner inlet side and the second transporting means is provided on the returning port side and the transporting capacity of the second transporting means is set higher than that of the first transporting means. The developing agent transported by the first transporting means to one end thereof can be quickly transported in the reverse direction preventing the developing agent from concentrating at the end of the first transporting means and being partly returned to the developing chamber.

Another object of the present invention is to provide a developing device characterized in that a developing tank (housing) separated into an upper chamber and a lower chamber by a partition wall whose front end is positioned within an angle θ formed between a line connecting a center axis of a developer roller with a center axis of a first transporting means and a line connecting the center axis of the developer roller with the circumference of the first transporting means and an inlet is formed between the front end of the partition and the restricting member, thus effectively feeding a restricted layer flow of the developing agent to the upper stirring chamber. This allows the developing agent to circulate, not in the developing chamber, but in a circulating route between the developing chamber and the stirring chamber, preventing uneven toner-concentration due to a holdup of a flow of developing agent and insufficient stirring of the agent.

Another object of the present invention is to provide a developing device having the same construction as described above and further characterized in that the end of the partition member horizontally dividing the developing tank into an upper chamber and a lower chamber characterized in that the tip of the partition member is disposed opposite to one of the magnetic poles of a magnet roller of the developer roller. This simple construction can reliably feed a developing agent restricted in amount by the regulating plate into the stirring chamber. In other words, the magnetic field of one magnetic pole of the developer roller can form a magnetic brush of developing agent, which can surely guide a developing agent rejected by the regulating plate upward into the stirring chamber, preventing the agent being returned into the developing chamber. A stable developing process can therefore be conducted.

Another object of the present invention is to provide a developing device having the same construction as described above and further featured in that the stirring means for stirring the developing agent returned thereto through the return ports and transferring the developing agent to the developer roller in the developing chamber is disposed opposite to the return ports and at a distance (m) from the transporting means in the stirring chamber, said distance being set to a value not more than one-half a total of diameter of the transporting means and the stirring means. This construction realizes rapid transfer of the developing agent through the return ports to the developing chamber by the action of gravity and with the help of transferring ability of the stirring roller in the developing chamber. Namely, the developing agent cannot accumulate near the return ports and rapidly falls on the stirring roller in the developing chamber wherein the agent is stirred and fed to the developer roller. Consequently, an unused portion of the developing agent after the regulating plate is fed into the stirring chamber and effectively returned into the developing chamber, thus keeping a constant level of the developing agent in the developing chamber. Toner concentration can be stably detected and a stable developing process with a constant feed of the developing agent is realized.

Another object of the present invention is to provide a developing device which is intended to realize a more stable supply and circulation of the developing agent and is provided with a developer roller for transferring, by electrically adsorbing thereto, a developing agent consisting of toner particles and carrier particles. The developing device comprises a developing chamber containing the developer roller and a stirring roller for stirring and transferring the developing agent to the developer roller and a stirring chamber disposed above the developing chamber and containing therein transporting means for stirring and transporting the developing agent, wherein a regulating member for limiting an amount of the developing agent to be applied to the developer roller is disposed opposite to the developer roller, an inlet opening is formed for allowing the developing agent rejected by the regulating member to enter into the stirring chamber, return ports are provided for returning the developing agent stirred in the stirring chamber into the developing chamber and a return regulating plate for limiting an amount of the developing agent to be returned through the return ports and returning the developing agent to the opposite side of the stirring roller opposing to the developer roller in the developing chamber.

In the above-described developing device, the developing agent is stirred while it is circulated between the developing chamber and the stirring chamber. In this case, the developing agent naturally falls through the return ports into the developing chamber by the action of gravity. The developing agent circulating in the stirring chamber and the developing chamber can be kept at a constant level by designing the sizes of the inlet opening and the return ports. Otherwise, the amount of the developing agent to be returned into the developing chamber may be irrevocably increased, resulting in excessive accumulation of developing agent therein.

This problem can be solved by providing a return regulating plate for restricting the amount of the developing agent to be returned into the developing chamber. This simple design solution can stabilize a flow of the developing agent to be returned, transferred and circulated, eliminating the possibility of excessive or insufficient accumulation of the developing agent in the developing chamber. The flow of the developing agent can be also improved, preventing the developing agent from being still, insufficiently stirred or having unstable toner concentration. Namely, defective development of latent image due to insufficient stirring of the developing agent and/or poor quality of toner developed image due to uneven toner concentration of the developing agent can be effectively prevented. Furthermore, the developing device is compact owing this to its construction allowing developing agent to circulate between the upper stirring chamber and the lower developing chamber. Therefore, any image forming apparatus using the developing device may save the size of its whole system.

Another object of the present invention is to provide a developing device having the same construction as described above and further featured in that the return regulating plate is mounted with a downward sloping end located at a level not higher than the uppermost position (top dead point) of the stirring roller. This allows the developing agent to be returned from the stirring chamber to the reverse side of the stirring roller disposed parallel to the developer roller in the developing chamber. The developing agent is returned to the stirring roller and cannot be returned directly to the developing chamber. The flow of the developing agent to be returned can be suitably regulated to maintain a normal level of the developing agent in the developing chamber.

Namely, an amount of the developing agent is returned from the stirring chamber through return ports first to the stirring roller and then fed by the stirring roller to the developer roller. In this instance, the return regulating plate has its tip below the uppermost position of the stirring roller. The stirring roller has the protrusion from the upper surface of the developing agent in the developing chamber. In other words, the uppermost portion of the stirring roller protrudes, i.e., is exposed in a vacant space left in the developing chamber, preventing the excessive accumulation of the developing agent therein. In this condition, a driving torque for rotating the stirring roller does not increase and does not give a large stress to the developing agent that can have a stable electrostatic charge. The developing agent can be well circulated and transferred with no local residence.

Another object of the present invention is to provide a developing device having the same construction as described above and further featured in that the end of the return regulating plate extends in the tangential direction of the circumference of the rotating stirring roller, enabling the stirring roller to immediately stir returned developing agent and feed it to the developer roller. This eliminates the possibility of clogging the return ports with the returned developing agent that may hinder normal circulation of the developing agent and decrease its fluidability. The developing device allows the developing agent to be effectively transported along the circulation route therein with no obstruction.

The above-described return regulating plate must be made of non-magnetic material that cannot be magnetized by the magnetic field of the developer roller. If the return regulating plate would be magnetized, it may catch the developing agent, obstructing the transportation and circulation of the agent. The return regulating plate made of elastic material can absorb a sudden large load of the developing agent by its elastic deformation and can smooth the amount of the developing agent, thus assuring stable transportation and circulation of the developing agent.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

FIG. 5A is a plan view of the stirring roller and FIG. 5B is a plan view of the stirring roller turned by 90° from the state shown in FIG. 5A.

PREFERRED EMBODIMENT OF THE INVENTION

Figure 3:
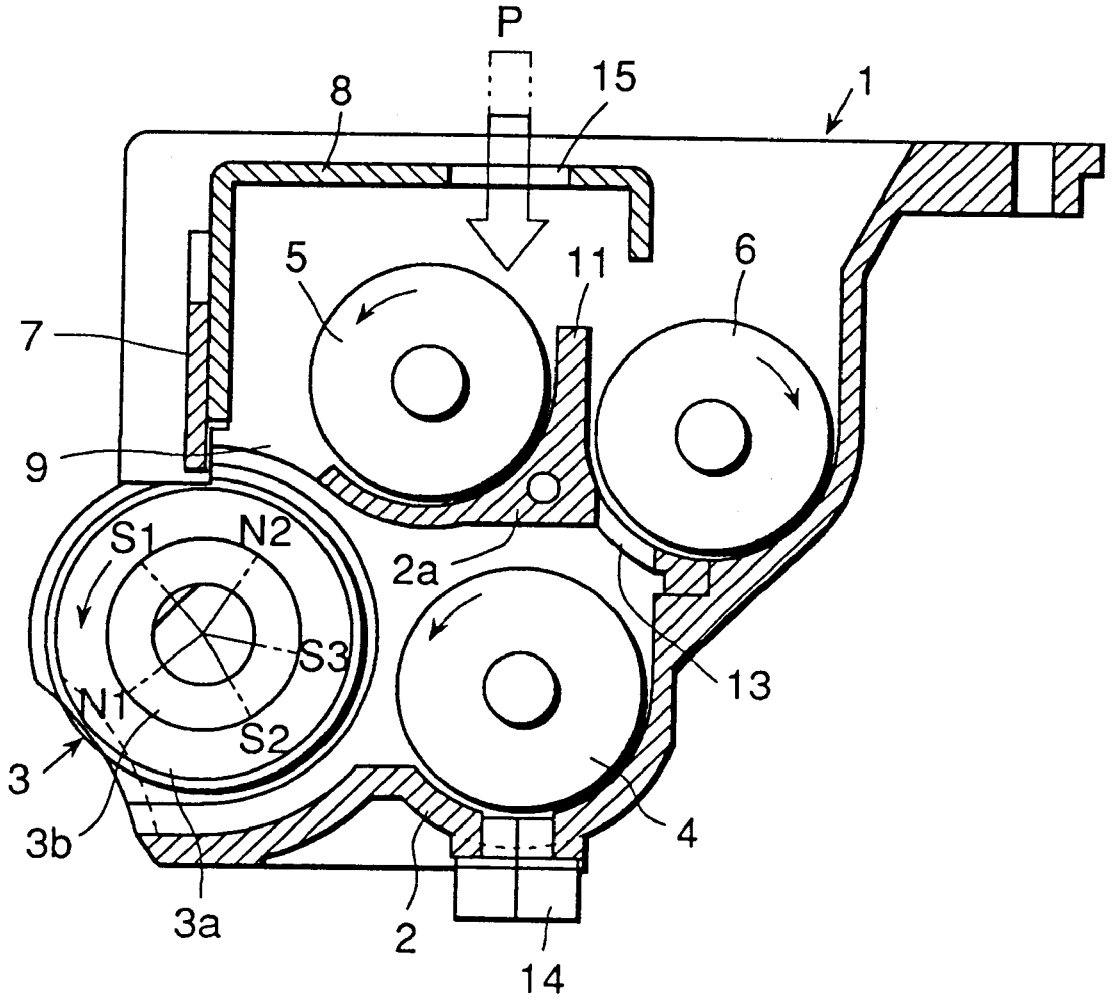
FIG. 3 is a construction view of a developing device according to the first embodiment of the present invention.
Figure 4:
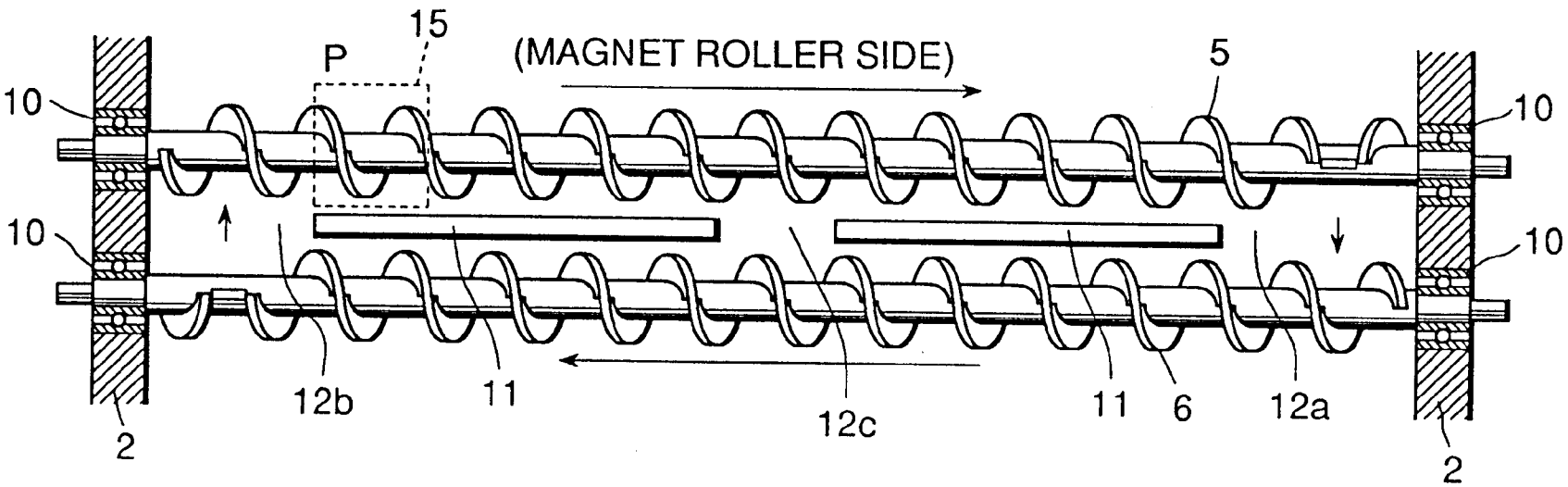
FIG. 4 is a plan view of screw rollers mountable in a chamber for making-up toner particles and stirring and transporting developing agent in a housing of a developing device of FIG. 3.

Referring now to the accompanying drawings, preferred embodiments of the present invention will be described below in detail. FIGS. 3 and 4 show a developing device which is the first embodiment of the present invention. Although a developing device best suited to a tandem system will be explained by way of example, the present invention is not be limited to the tandem system, and therefore relates to developing devices for developing a latent image formed on a light-sensitive body (image carrier), such devices are compact with a small horizontal size (width) and can effectively stir the developing agent and are adapted for high-speed copying processes.

Prior to explanation of the developing device of FIGS. 3, and, the construction of an image forming apparatus is briefly described with reference to FIG. 11.

An image-forming apparatus 30 contains in its center a light-sensitive body 31 formed in the shape of an image-carrying drum rotatably drivable during an image forming process, and accommodates therein a variety of toner-image processing means disposed around a cylindrical surface of the light-sensitive drum 31.

The processing means comprises a charger 33 for evenly charging the surface of the light-sensitive drum, an optical system (image exposure device) 32 for building up a light image on the light-sensitive drum, a developing device 1 according to the present invention for visualizing an electrostatic latent image formed on the light-sensitive drum 31, a toner image transferring unit 34 for transferring a toner-developed image onto a paper sheet or an intermediate transfer body, a stripping member (discharger member) 35 for separating the paper sheet with the developed toner image thereon from the light-sensitive drum, a cleaning device 36 for removing a developing agent (toner) remaining on the light-sensitive drum and a discharger 37 for removing an electrostatic charge from the surface of the light-sensitive drum. The above-listed components are arranged in the described order in the rotation direction of the light-sensitive drum.

In the case of the color-image forming device with tandem developing systems, light-sensitive drums are provided each with a set of the above-mentioned processing means disposed therearound and developing devices 1 using different color toners are provide one for the corresponding light-sensitive drum. The other processing means used for respective systems are identical. Color images developed with different color toners respectively, are transferred for example to an intermediate transferring body wherefrom a developed color-image is transferred onto a paper sheet. Alternatively, a sheet adsorbed onto a transporting belt is transported through respective light-sensitive drums for receiving thereon respective color images in succession.

Figure 11:
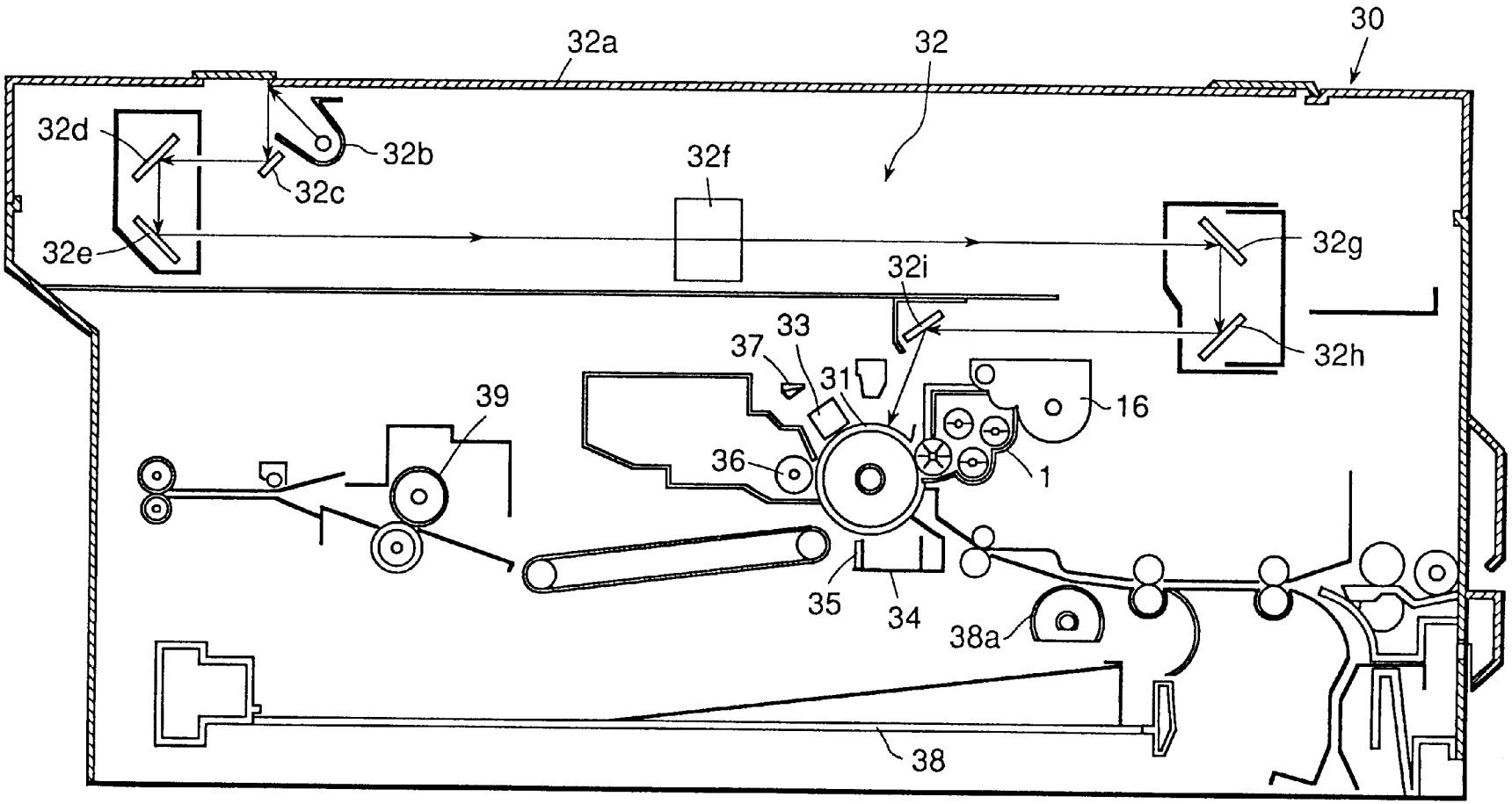
FIG. 11 is a schematic internal construction view of a developing device according to the present invention.

With the device of FIG. 11, a sheet from a tray or a cassette accommodating a number of sheets is fed by a sheet feeder 38*a* and transported to an image copying position. The sheet with the toner-developed image is separated from the light-sensitive drum 31 and transported to a fixing device 39.

The fixing device 39 is used for fixing an unfixed toner image onto the sheet and consists of a heat roller being heated to a specified temperature for fusing toner onto the sheet and a pressure roller for pressing the sheet onto the surface of the heat roller. The sheet with the toner image fixed thereon is delivered by a delivery roller (not shown) out of the image forming device.

A paper sheet can be fed not only from the cassette 38 but also from a sheet feeding unit allowing a necessary cassette to be attached to the bottom of the image forming device. The sheet feeding unit feeds a sheet to a copying position along a specified transporting route. A manual sheet-feeder is also provided for feeding any different format of a sheet as necessary.

On the other hand, the optical system 32 for exposing the surface of the light-sensitive drum 31 is composed of a first scanning means provided with an illuminating device 32*b* including a lamp for illuminating an original document place on a transparent glass-made table 32*a* and a first mirror 32*c* for reflecting light from the original to a specified plane, a second scanning means supporting a second mirror 32*d* and a third mirror 32*e* for directing the reflected light from the first scanning means to a lens for focusing a light image onto the surface of the light-sensitive drum 31, a pair of fixed mirrors 32*g* and 32*h* for adjusting the length of an optical pass, for bring the reflected light through focusing lens 32*f* to the light-sensitive drum 31 and a fixed mirror 32*i*, to finally for applying the reflected light image onto the light-sensitive drum.

The preferred embodiments of the present invention are described bellow referring the accompanying drawings.

(Embodiment 1)

FIG. 3 is illustrative of a developing device which is the first embodiment of the present invention. The shown developing device 1 stores therein a developing agent including toner (coloring agent) for visualizing an electrostatic latent image formed on a light-sensitive drum 31 shown in FIG. 11.

In FIG. 3, the developing device 1 has a developing tank (housing) 2 with the developing agent stored therein and accommodates therein a rotatably supported developer roller 3 and a stirrer roller 4 for transporting or/and stirring the developing agent and, in the upper portion of the tank above the developer roller and the stirrer roller 4, screw rollers 5 and 6 disposed in parallel with each other for supplying toner and circulating the developing agent.

The developer roller 3 is composed of a cylindrical sleeve made of non-magnetic material 3*a* and a magnet roller 3*b* having five magnetic poles (the odd number of poles) disposed inside the sleeve 3*a*. The magnet roller 3*b* is securely supported with its developing magnetic pole N1 directed to a specified developing position opposite to the light-sensitive drum 31. The sleeve 3*a* surrounding the magnetic roller 3*b* can rotate in the direction shown by an arrow to carry developing agent attached thereto by the effect of the magnetic force of the magnet roller 3*b*. A developing agent left on the sleeve after the developing process is removed therefrom and collected into the developing tank 2.

The developing agent is a two-component type agent composed of toner particles and carrier particles or one-component type agent composed of toner particles having magnetism in itself. The developing agent is attached onto the surface of the non-magnetic sleeve and magnetically adsorbed by the magnetic force of the magnet roller. An excessive part of toner particles adsorbed on the surface of the rotating sleeve 3*a* is removed off by a regulating member (doctor) 7 to form a constant thick layer of toner before it is transported to a developing position. The regulating member 7 at one end secured to a frame 8 attached to the developing tank 2 and at the other end disposed at a specified gap (distance) from the rotating sleeve 3*a*. Therefore, a layer of the developing agent on the sleeve is regulated to a constant thickness (amount) by the regulating member 7.

Figure 2:
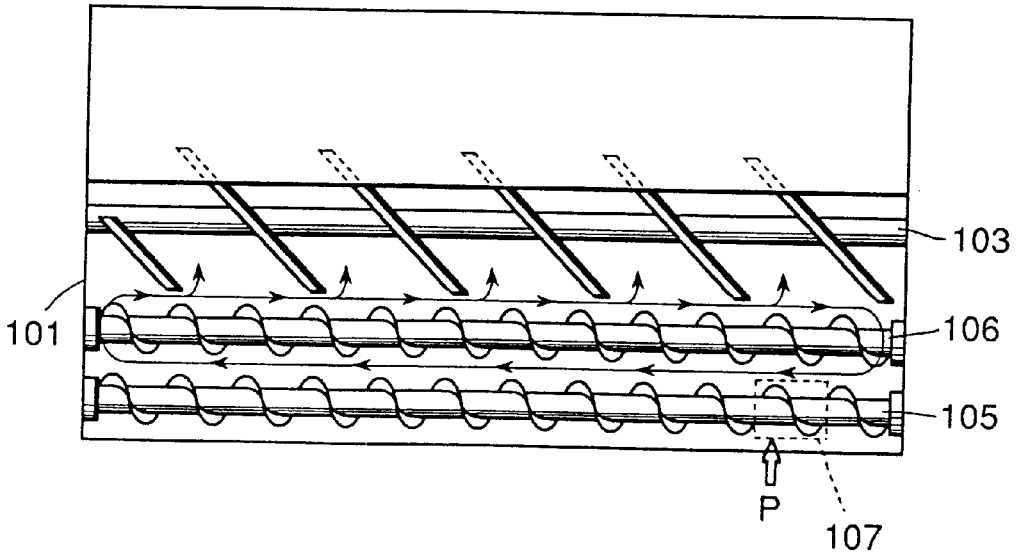
FIG.2 ( PRIOR ART )
FIG. 2 is a top plan view of the conventional developing device of FIG. 1.

As mentioned, referring to FIG. 2 for a conventional example, the stirring roller 4 is a rotary shaft provided with oval stirring blades arranged thereon at an equidistance and at a specified angle of inclination. The stirring roller may be provided with a number of spiral (screw-type) blades similar to those of toner-transporting rollers.

Figure 5A:
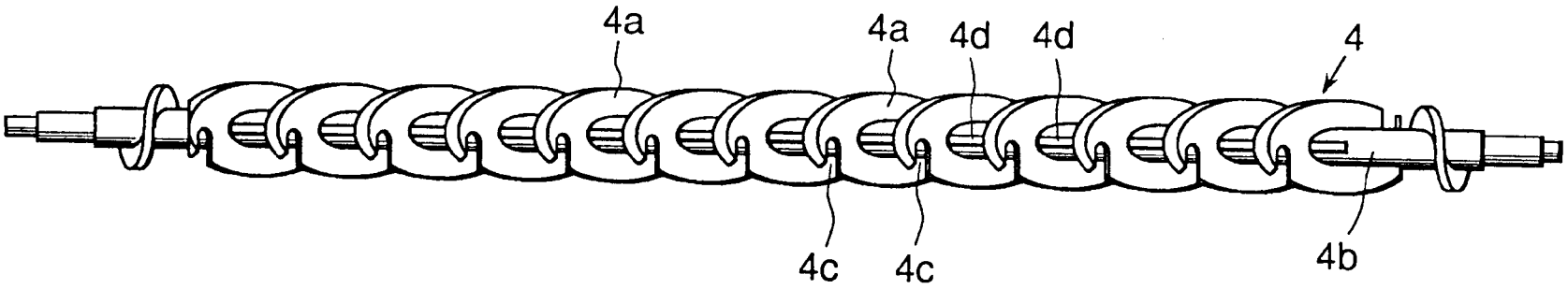
FIGS. 5A and 5B show an exemplified construction of a stirring roller mountable in a developing chamber of a developing device of FIG. 3.
Figure 5B:
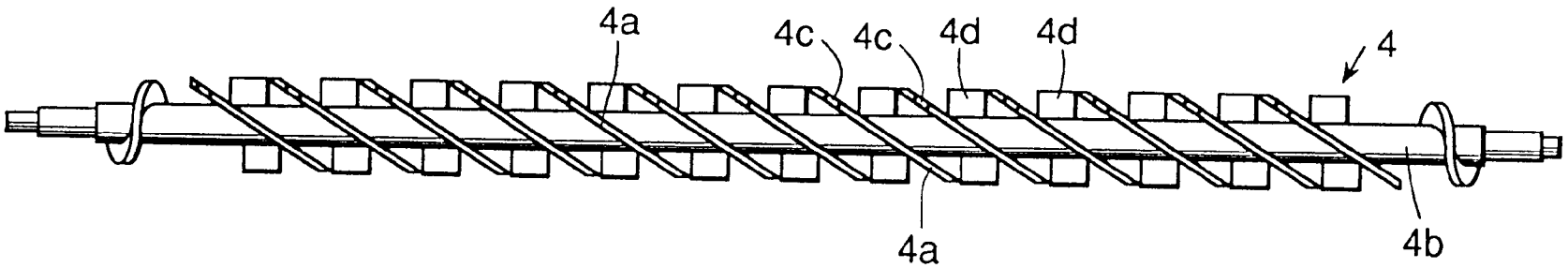

The stirrer roller 4 may also be of the type shown in FIGS. 5A and 5B. The shown stirrer roller 4 is composed of a rotary shaft 4*b* having a number of blades (flanges) 4*a* fixed thereon at a specified inclination angle. As shown in FIG. 5A, each blade 4*a* has a notch 4*c* allowing the developing agent to be fed in the axial direction. Feeding elements 4d are also provided between the vanes 4*a* and secured onto the rotary shaft 4*b*. The stirring roller 4 thus constructed can stir and feed the developing agent to the developer roller 3 and returns the collected developing agent to the opposite side.

As shown in FIG. 3, the stirring roller 4 is driven in rotation in the direction indicated by an arrow to transport the developing agent in the axial direction by oval blades 4*a* stirring the agent at the same time. The feeding members 4*d* stir and transport the developing agent in the direction normal to the direction of the axis 4*b*. The developing agent thus stirred and transported by the stirring roller 4 inside the developing tank 2 is supplied to the developer roller 3. In this case, the developer roller 3 sucks up the developer agent by the magnetic force of the magnetic pole S3 of the magnet roller 3*b*.

As described before, the developing agent is magnetically adsorbed on the surface of the rotating sleeve 3*a* of the developer roller 3 and an excessive amount thereof is removed off by the regulating member (doctor) 7 disposed opposite to the area between magnetic poles S2 and S1 of the magnet roller 3*b* inside the sleeve 3*a*. A specified amount of the developing agent adsorbed on the rotating sleeve 3*a* is transported through the magnetic field of magnetic pole S1 to the magnetic field of the developing magnetic pole N1, whereby the developing agent particles are magnetically excited to stand up thus making contacting with the surface of the light-sensitive drum. Toner particles are attached to the electrostatic latent image formed on the surface of the light-sensitive drum.

After this, the sleeve 3*a* with the developing unit remaining thereon, rotates to collect the agent into the developing tank through cooperation with the magnetic pole S2 of the magnet roller 3*b*. The agent is separated from the sleeve 3*a* by the interaction of magnetic poles S2 and S3 of the magnet roller 3*b* and then transported by feeding elements 4*d* of the stirring roller 4 (FIG. 5) in a direction opposite to the developing roller 3. The collected developing agent is sufficiently stirred for subsequent use and fed to the developer roller in the above described manner. The developing agent can be thus collected from the developing position and recycled for the developing process.

In the developing device of the present invention, developing agent removed off the sleeve by the regulating member 7 in the midway to the developing position is also returned to the stirring roller 4. This is achieved by dividing the inside space of the developing tank 2 into two parts horizontally at the level of the regulating member 7 as shown in FIG. 3. In the other words, the developing tank 2 is internally divided by a partition wall 2*a* into two chambers, a lower one is a developing chamber accommodating therein the developer roller 3 and the stirring roller 4, and upper one is a stirring chamber accommodating therein the stirring screw rollers 5 and 6.

A gap between the front edge of the partition wall 2*a* and the regulating member 7 forms an inlet opening 9 over the whole axial length of the developing roller 3. Consequently, excessive particles of the developing agent are removed off by the regulating member 7 and are transferred through the inlet opening 9 onto the partition wall 2*a*.

In the stirring chamber above the partition wall 2*a*, there are provided two screw rollers 5 and 6 for mixing a compensatory toner with the developing agent returned through the inlet opening 9 and transporting the mixture with stirs. These screw rollers 5 and 6 are rotatably fitted at both ends in bearings 10 secured to the side wall of the developing tank 2 as shown in FIG. 4.

The screw roller 5 arranged opposite to the inlet opening 9 is intended to mix a supply of toner with the developing agent fed through the inlet opening 9 and stir and transport the mixture in the direction indicated by an arrow in FIG. 4. The screw roller 6 disposed parallel with the screw roller 5 has spiral blades directed in the same direction as the screw roller 5, but rotates in the reverse direction to transport the developing agent with toner in the reverse direction.

A toner supplying unit 16 is detachably fitted in the toner supply port 15 of the developing device 1 as shown in FIG. 11. The toner supply unit 16 has an outlet communicating with the toner supply port 15 and has toner-supplying means provided thereat. Toner is supplied, as necessary, from the toner supply unit 16 through the toner supply port 15 to the screw roller 5 in the stirring chamber.

A baffle plate 11 provided between the screw rollers 5 and 6 in the stirring chamber is intended to prevent the developing agent from being fed from one screw roller to the other and reverse in the cross direction. This baffle plate 11 is integrally formed with the partition wall 2*a* and has passage holes 12*a*, 12*b*, 12*c* by one in a center portion and both end portions. The end-portion passage holes 12*a* and 12*b* are openings through which developing agent transported by the screw roller 5 or 6 is transferred unidirectionally as indicated by an arrow to the screw roller 6 or 5. The center passage hole 12*c* allows bi-directional transfer of the developing agent from one screw roller to the other and reverse.

Developing agent fed through the inlet opening 9 is transported first by the screw roller 5 to one end of its axis. In midway, a part of the developing agent is transferred through the center passage hole 12*c* to the screw roller 6. When the developing agent reaches to the end portion opposite to the passage hole 12*a*, it is fed through the passage hole 12*a* to the screw roller 6 by the action of a reversely directed end-blade of the screw roller 5. The developing agent is further transported by the screw roller 6 to the reverse end thereof and then transferred through the passage hole 12*b* to the screw roller 5.

The screw rollers 5 and 6 transports the developing agent. Particularly, the screw roller 6 transports the developing agent, feeding down the agent partly on its way to the stirring roller 4 through a return port 13 made in the partition member 2*a* at a level slightly higher than the bottom surface of the screw roller 6, as shown in FIG. 3. Like the inlet opening 9, the return hole 13 is formed in the member 2*a* along the whole length of the rotation axis of the screw roller 5.

Consequently, developing agent transported by the screw roller 5 is transferred at it send to the screw roller 6, whereby the agent is further transported in the reverse direction, partly falling down through the return port 13 and collected by the stirring roller 4.

The toner concentration sensor 14 for detecting the concentration of the toner in the developing agent is disposed under the stirring roller 4 on the bottom of the developing tank 2. This toner concentration sensor 14 may be for example a permeability sensor whose output increases as an amount of toner in the developing agent decreases, thus detecting an insufficient amount of toner in the developing agent collected in the developing tank 2.

When an insufficient toner concentration is detected by the sensor 14, fresh toner is supplied from the toner supply unit 16 through the toner supply port 15 in a direction P (FIG. 3) to compensate for lack of toner. The toner supply unit 16 attached to the top of the developing device 1 has an outlet port communicating with the toner supply port 15 provided in one end portion of the developing device 1. Toner from the toner supply unit 16 is supplied into the developing device 1 through the toner supply port 15 which is positioned opposite to the end portion of the screw roller 5, whereat the axial feed of toner by the screw roller 5 starts (see FIG. 4).

The developing device 1 now starts the process for developing an electrostatic latent image formed on the light-sensitive drum 31, thus driving the sleeve 3*a* in rotation. A developing agent adsorbed on the surface of the rotating sleeve 3*a* is restricted by the regulating member. The excessive part of the developing agent is removed and transferred toward the screw roller 5 on the partition wall 2*a* through the inlet opening 9, being pushed by developing agent successively transported by the rotating sleeve 3*a*.

If the toner concentration of the developing agent in the developing tank is insufficient, the toner concentration sensor 14 produces a detection signal by which the toner supply unit supplies toner into the developing device through the toner supply port 15. Fresh toner and the excessive developing agent removed by the regulating member 7 are mixed together while being transported by the screw roller 5. The mixture is transported, being stirred simultaneously, in the axial direction of the rotating screw roller 5 to the end thereof, whereby it is transferred to the screw roller 6. The developing agent is then transported by the screw roller 6 in the reverse direction.

The developing agent is gradually returned through the return port 13 to the stirring roller 4 while it is transported by the screw roller 6. The collected developing agent has been sufficiently stirred and is further stirred by the stirring roller 4 before being fed to the developer roller 3.

After development of a latent image formed on the light-sensitive drum, the developing agent remaining on the sleeve 3*a* is collected from the developing position of the sleeve into the developing tank 2. An unused developing agent removed by the regulating member 7 is transferred to the screw roller 5 disposed at the toner-supply side of the stirring chamber. The unused developing agent is mixed with fresh toner and transported while being stirred by the screw roller 5. The developing agent is further transported by the screw roller 6, gradually being fed to the stirring roller 4. The developing agent fed to the stirring roller 4 is mixed with the developing agent collected from the sleeve 3*a* and stirred by stirring roller 4 and supplied to the developer roller 3.

Thus, the above-described construction of the developing device allows a developing agent to circulate between two chambers, one of which is a so-called developing chamber containing the developer roller 3 and the stirring roller 4 and the other is a so-called stirring chamber having a toner supply inlet and containing the screw rollers 5 and 6. In comparison with the conventional developing device of FIG. 1, this developing device has the advantage that the developing agent is sufficiently mixed with a supplied toner and/or is sufficiently stirred while being transported in the circulating route between the two chambers and supplied, i.e., returned to the stirring roller 4.

Figure 1:
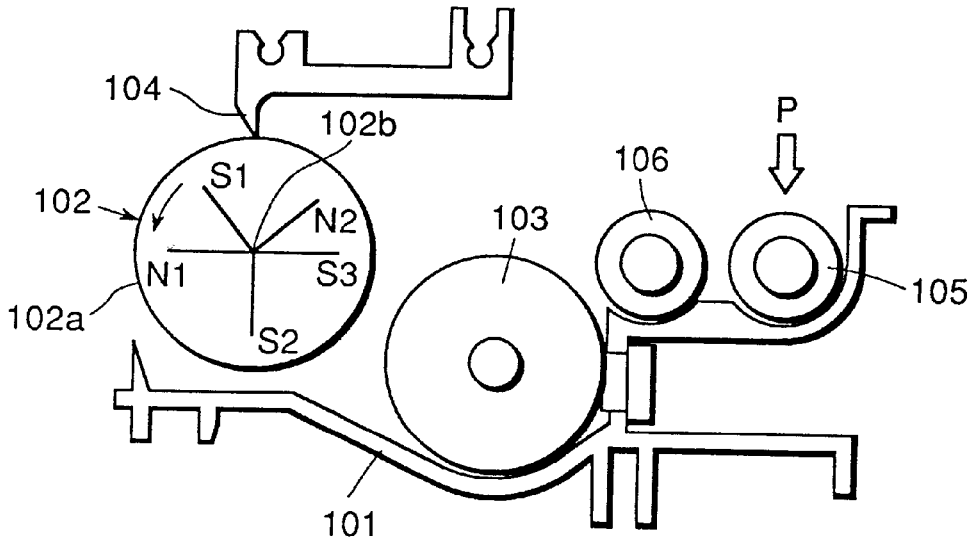
FIG.1 ( PRIOR ART )
FIG. 1 is a typical construction view of a conventional developing device.

In the conventional developing device of FIG. 1, toner supplied for compensating for consumed toner particles is mixed with developing agent and stirred only by the stirring roller 103, resulting in feeding insufficiently stirred agent having unstable concentration. On the other hand, developing agent removed off by the regulating member 104 is circulated only through the stirring roller 4, resulting in prolonged residence of the agent in the developing chamber. In consequence, stable feeding of evenly concentrated agent cannot be realized.

On the contrary, the developing device according to the present invention can sufficiently stir the developing agent with fresh toner enough to make the toner be stably charged, assuring the high quality of a developed toner image.

The conventional developing device of FIG. 1 cannot sufficiently mix and stir fresh toner with the developing agent during a developing process, causing toner to have unstable electrical charge. This may deteriorate the quality of a toner-developed image by fogging. On the contrary, the developing device according to the present invention can perform smooth and effective mixing and stirring of fresh toner with developing agent being used, realizing the high-speed developing process.

The developing device 1 according to the present invention has a very compact body having a small width in a horizontal direction, owing to the fact that the screw rollers 5 and 6 for transferring toner to the stirring roller 4 are positioned above the stirring roller 4 and the developer roller 3. This design can also facilitate sufficient stirring of the developing agent, mixing a compensatory toner with the developing agent and stirring of the mixture.

The use of the developing device 1 as a developing means for developing an electrostatic latent image formed on the light-sensitive drum 31 can save a width amount in the horizontal direction of a toner image forming apparatus in which a paper sheet is transported to be printed. A tandem type color image forming apparatus can have a compact size of body including the developing devices 1 attached thereto in a horizontal direction.

The toner supply port 15 is positioned opposite to an end of the screw roller 5 separated by the baffle plate 11 with a passage hole 12*a* as shown in FIG. 4. If the supplied toner flows reversely through the passage hole 12*b* to the screw roller 6 due to crowded flow of the developing agent, the compensatory toner may not be mixed and stirred with the developing agent and immediately fed through a return port 13 to the stirring roller 4, resulting in an increased toner concentration of developing agent to be fed to the developing roller. The application of the developing agent having an increased toner concentration may cause fogging of the tone-developed image.

To avoid the above, the toner supply port is located in an area separated by the baffle plate 11 and near a start point of feeding of the developing agent as shown in FIG. 4. The developer roller can be supplied with the developing agent containing the compensatory toner sufficiently mixed/stirred with existing components therein.

In the stirring chamber, the baffle plate 11 between the screw rollers 5 and 6 has the passage hole 12c in its center portion, the hole is effective to promptly detect whether the developing agent restores a reference concentration of toner therein. Furthermore, the fresh toner supplied onto an end portion of the screw roller 5 is partly transferred the reversely directed flow in the screw roller 6 through the center passage hole 12*c*, so that the compensatory toner may be promptly and evenly distributed in both axial flows of the developing agent.

Figure 6:
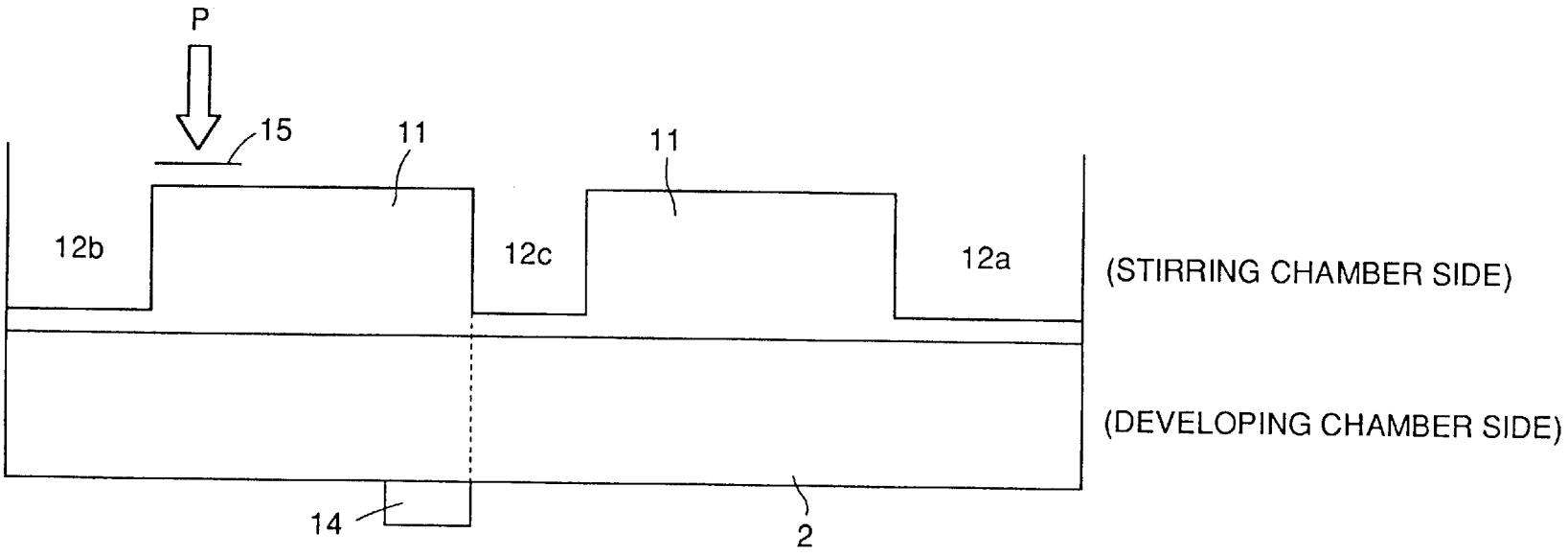
FIG. 6 is a mimic diagram showing the relationship between positions of a toner supplying portion, a baffle plate of a stirring chamber and a toner density sensor of a developing chamber of the developing device of FIG. 3.

Prompt detection of a toner-concentration of the developing agent after addition of the compensatory toner can be realized by via the toner concentration sensor 14 at an adequate position as shown in FIG. 6.

FIG. 6 shows a typical relative location of a baffle plate 11 with passage holes 12*a*, 12*b*, 12*c* in the stirring chamber and a toner concentration sensor 14 on the bottom of the developing chamber of the developing tank 2. A compensatory toner is stirred with a developing agent and transported by the screw roller 5 and partly transferred through a center passage hole 12*c* to the screw roller 6. The developing agent containing the compensatory toner is stirred and transported in a reverse direction by the screw roller 6, being midway returned through the return port to the stirring roller 4. Toner concentration of the developing agent returned therein is measured by the sensor 14 disposed on the bottom of the developing chamber of the developing tank 2.

The toner concentration sensor 14 is disposed with a small displacement to the downstream-side from the position opposing the passage hole 12*c*, as shown in FIG. 6. This allows a supply of the toner to be mixed and stirred with developing agent and to be partly transferred through the center passage hole 12*c* to the screw roller 6. The mixture is gradually fed to the stirring roller 4, while being further transported by the screw roller 6. The mixture is further mixed with the developing agent, collected after the developing process, in the developing chamber by the stirring roller 4, and the toner concentration of the developing agent to be used for subsequent developing processes is measured by the toner concentration sensor 14 disposed on the bottom of the developing chamber. This can prevent excessive supply of fresh toner not to exceed the normal toner concentration of the developing agent. The sensor 14 can assure accurate detection of toner concentration since its location is protected from direct falling thereon of the fresh toner without being mixed and stirred with the developing agent.

In the developing device 1, the stirring roller 4 disposed in the developing chamber composes stirring means and the screw rollers 5 and 6 in the stirring chamber compose the first and second stirring/transporting means.

(Embodiment 2)

In the above-described developing device 1, the stirring chamber for supplying toner is disposed above the developing chamber containing the developer roller 3 and the stirring roller 4 and an excessive amount of developing agent is fed back by the regulating member 7 into the stirring chamber wherein the developing agent is mixed with fresh toner and transported. The developing agent in sufficiently stirred state is fed to the stirring roller 4 in the lower developing chamber. Thus the developing agent circulated in the developing device.

In this instance, developing agent shall be returned evenly on the axial length of the stirring roller 4 through the return port 13 while being transported in the stirring chamber. Otherwise, local accumulation of the developing agent on the stirring roller 4 occurs. This not only causes an increased load thereat, but also causes uneven application of the developing agent to the developer roller, resulting in defective development of a toner image. This problem can be resolved by returning the developing agent in such a way that it is evenly distributed in the axial direction area of the return port 13 provided at the screw roller side when it is returned to the stirring roller 4 in the developing chamber.

An example of the solution is the provision of the passage hole 12*c* in a center portion of the baffle plate as shown in FIG. 4. Developing agent is transported in an axial direction by the screw roller 5 and a part of the developing agent is transferred through the center passage hole 12*c* to the screw roller 6 and transported in the reverse direction, being gradually transferred through a return port 13 to the stirring roller 4 in the developing chamber. The remainder of the developing agent is transported by the screw roller 5 to its one end, whereat the remainder is transferred through the end passage hole 12*a* to the screw roller 6 and further transported in the reverse direction, being gradually transferred through the return ports 13 to the stirring roller 4. This can effectively prevent developing agent from being unevenly distributed on the screw roller 6.

Figure 7:
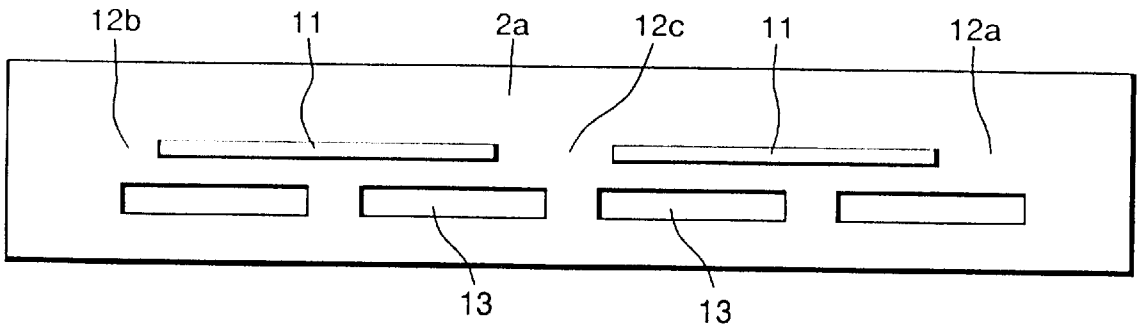
FIG. 7 is a construction plan view of a partition plate viewed from a toner supplying portion of a stirring chamber which is an upper one of two chambers formed by the partition plate in a developing device and contains screw rollers (not shown).

Furthermore, the return port 13 is formed not continuously but as a plurality of separate holes formed in separate portions as shown in FIG. 7. Each return port does not totally cover but partly overlaps with one of passage holes 12*a*, 12*b* and 12*c* formed in the baffle plate 11. If a return port covers the entire area of the passage hole 12*a* in the baffle plate, developing agent transferred from the screw roller 5 through the passage hole 12*a* to the screw roller 6 may be collectively transferred through the return port 13 to the stirring roller 4 when being transported in the reverse direction. To avoid this, return ports 13 are arranged with a suitable distance between them in view of locations of the passage holes in the baffle plate 11 as shown in FIG. 7. In other words, developing agent can be evenly collected on the stirring roller 4, while being transported in the reverse direction by the screw roller 6.

The number of return ports 13 is not limited to 4. In the case of FIG. 7, two return ports 13 are arranged for one baffle plate 11 but return ports 13 more than 4 may also be provided. When developing agent is transported leftward by the screw roller 6 (in FIG. 7), wedge-shaped return ports 13, gradually widened, are preferably arranged in a direction right to left. This allows developing agent to be returned effectively with an even distribution in the axial direction.

On the other hand, in FIG. 4, the screw rollers 5 and 6 have the same screw pitch. Therefore, they have the same transporting capacity at the same rotation speed. However, the developing agent is gradually returned through return ports 13 to the stirring roller 4, while being transported by the screw roller 6. Consequently, the amount of the developing agent on the screw roller 5 is any time larger than that on the screw roller 6. This may result in accumulation of the developing agent on both end portions of the screw roller 5. The distribution of a larger amount of the developing agent on the transferring end of the screw roller 5 may increase the amount of the developing agent to be returned from the starting end portion of the screw roller 6 to the stirring roller 4 through the corresponding return port 13. The developing agent may stay still without being stirred. The use of insufficiently stirred developing agent results in obtaining poor quality of toner-developed images.

The above problem can be solved by increasing the transporting capacity of the screw roller 6 larger than that of the screw roller 5 by increasing the rotation speed of the former. Namely, the screw roller 5 can be loaded with a large volume of the developing agent from the screw roller 5, eliminating the piling of the agent on the transferring end of the screw roller 5. The developing agent is evenly distributed and returned through the return ports 13 to the stirring roller while being transported in the reverse direction by the screw roller 6.

Figure 8:
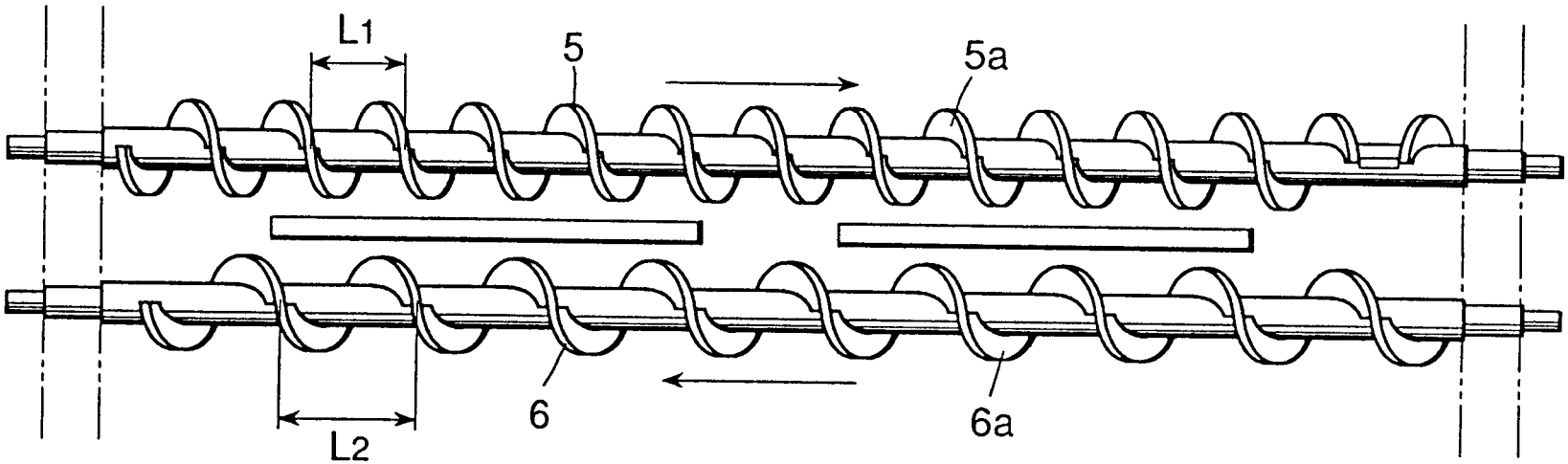
FIG. 8 is a plan view of a pair of screw rollers to be mounted in a stirring chamber of the developing device according to the second embodiment of the present invention.

Alternatively, the screw pitch L2 of the screw 6*a* of the screw roller 6 may be increased larger than the screw pitch L1 of a screw 5*a* of the screw roller 5, as shown in FIG. 8, if a driving system requires the screw rollers 5 and 6 to rotate at the same rotation speed. The use of such screw rollers 5 and 6 (L1<L2) can increase the output of the screw roller 6 larger than that of the screw roller 5, thereby bringing the same effect as obtained by increasing of the rotation speed of the screw roller 6.

Furthermore, the output of the screw roller 6 of FIG. 8 can be further increased, if necessary, by increasing its rotation speed.

(Embodiment 3)

As described before with the first embodiment, a developing agent rejected by the regulating member 7 is fed to the screw roller 5 in the upper stirring chamber. If the developing agent cannot effectively be transferred to the screw roller 5 in the stirring chamber, particles may move downward and collide with particles adsorbed onto the rotating sleeve 3*a* of the developer roller 3, causing damage to the particles of developing agent.

The developing agent rejected by the regulating member 7 and not transferred to the screw roller 5 is directly returned to the stirring roller 4 in the developing chamber and may remain for a long time in the developing chamber, thereby causing a decrease in the toner concentration of the developing agent therein.

Figure 9:
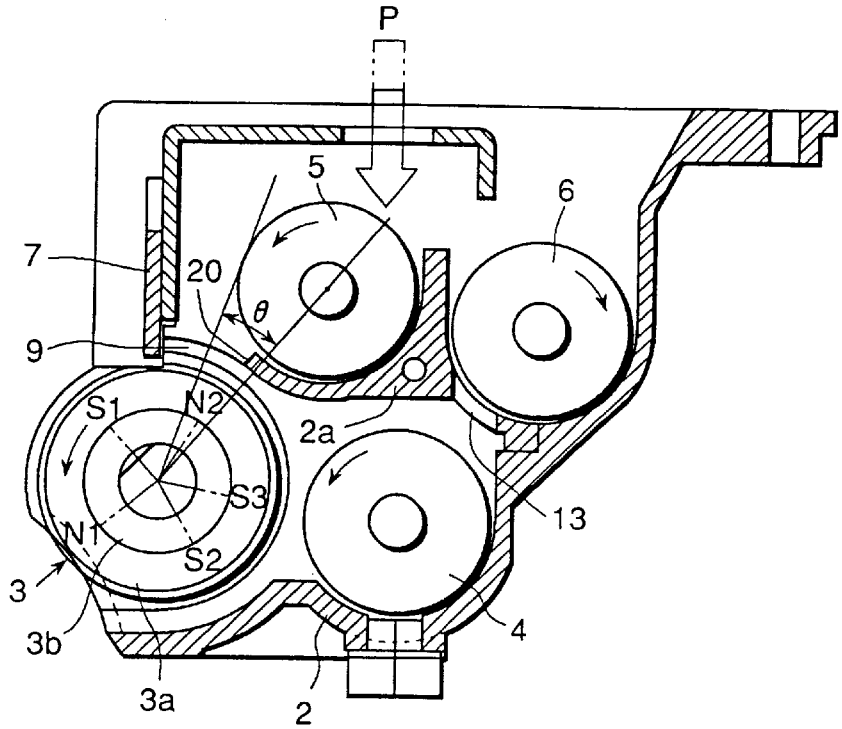
FIG. 9 is a construction view of a developing device which is the third embodiment of the present invention.

As shown in FIG. 9, the tip 20 of the partition member 2*a* is adequately positioned so that the developing agent transported by the developer roller 3 and rejected by the regulating member 7 may be effectively fed to the screw roller 5 in the stirring chamber. Namely, a gap between the tip 20 of the partition member 2*a* and the regulating member 7 is adapted to control a feed of the developing agent to the screw roller 5.

If a narrow inlet opening 9 is formed between the tip of the partition member 2*a* and the regulating member 7, a feed of the developing agent through the inlet opening 9 to the screw roller 5 is reduced and a larger remainder is returned to the stirring roller 4 in the developing chamber. With a wide inlet opening 9 formed therebetween, the developing agent rejected by the regulating member 7 can be fed onto the partition member 2*a* in the upper stirring chamber, but a part of the developing agent may be left without being loaded on the screw roller 5 and returned back from the partition to the stirring roller 4. In both the cases, the developing agent rejected by the regulating member cannot sufficiently be supplied to the screw roller 5 in the upper stirring chamber.

According to the present invention, the inlet opening 9 formed between the tip 20 of the partition member 2*a* and the regulating member 7 is set to a specified value at which a tip 20 of the partition member 2*a* may be disposed within a range of an angle θ formed by a straight line connecting the rotation axis of the developer roller 3 with the rotation axis of the screw roller 5 and a straight line connecting the rotation axis of the developer roller 3 and with a circumferential tip of a blade of the screw roller 5.

This construction allows the developing agent rejected by the regulating member 7 to flow through the inlet opening 9 to the screw roller 5 in the upper stirring chamber. In this instance, the tip 20 of the partition member 2*a* can maintain a sufficient space from the regulating member 7 and can effectively prevent the previously supplied developing agent from falling down from the partition member 2*a* until it is transferred on the screw roller 5. Accordingly, the developing agent rejected by the regulating member 7 can move on the partition member 2*a*, not being returned to the stirring roller 4, and transported sufficiently stirred by the screw roller 5. The developing agent is then transferred to the screw roller 6 whereby it is stirred and transported in the reverse direction, being gradually returned to the stirring roller 4 in the lower developing chamber.

The rejected developing agent can be effectively fed from the developing chamber into the stirring chamber wherefrom it is sufficiently stirred and returned to the stirring roller 4 in the developing chamber.

Figure 10:
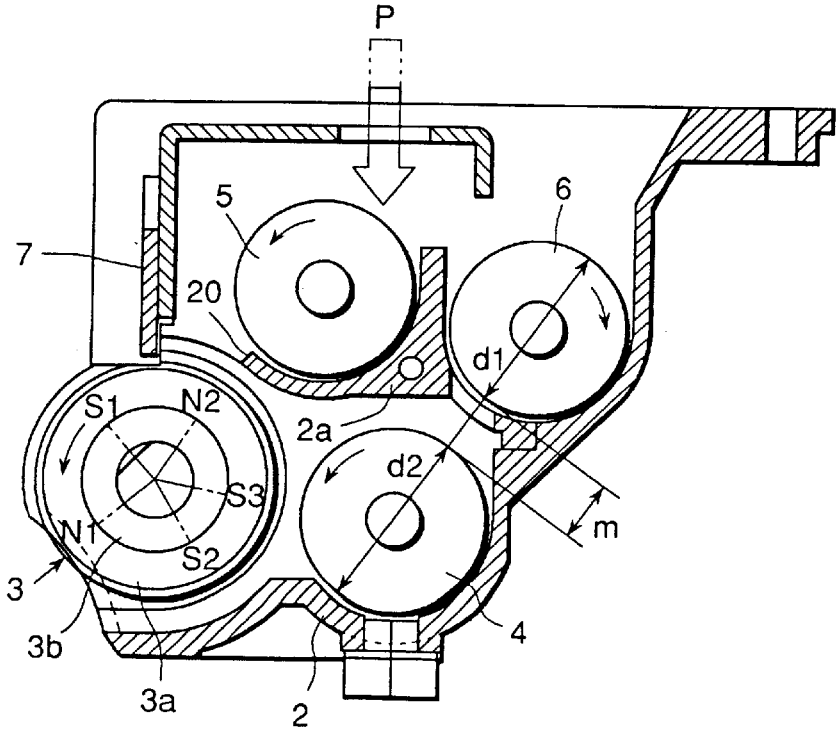
FIG. 10 is a view for explaining another modification of the developing device of the third embodiment of the present invention.

It is also effective to dispose a magnetic pole N2 of a magnet roller 3*b* composing the developer roller 3 opposite to the tip 20 of the partition member 2*a* as shown in FIG. 10. This allows the rejected developing agent to be effectively fed to the upper stirring chamber.

The developing agent may be magnetically excited, the particles of the magnetically excited developing agent come into contact with the tip 20 of the partition member 2*a* to form a weir and is reliably fed into the stirring chamber, not being returned directly from the inlet opening 9 to the stirring roller 4. The weir formed developing agent can also prevent the developing agent from reversely flowing from the screw roller 5.

The above-described effect can be achieved by merely disposing the tip 20 of the partition member 2*a* opposite to one of magnetic poles of the magnet roller 3*b* mounted in the developer roller 3 without strict positioning of the tip 20 of the partition member 2*a* relative to the regulating member 7. The further increased effect can be, of course, obtained by positioning the tip 20 of the partition member 2*a* within an area range of angle θ, as shown in FIG. 9, and opposite to the magnetic pole N2 of the magnet roller 3*b*, as shown in FIG. 10.

On the other hand, it is also important that a feed flow of the developing agent rejected by the regulating member 7 into the stirring chamber matches a return flow of the stirred developing agent into the developing chamber. The level of the developing agent in the developing chamber may sharply fluctuate if there is a large difference between an amount of developing agent supplied into the stirring chamber and a return amount of developing agent returned to the stirring roller 4 in the developing chamber. This may cause an unstable output of a toner concentration sensor and unstable developing processes with different supplies of developing agent. The developing process becomes unstable with an insufficient amount of the developing agent in the developing chamber while the developing process may cause fogging of toner developed image due to over-toner development since the sensor 14 detects a lack of toner in the developing chamber.

To avoid this, it is necessary to stabilize a flow of the developing agent to be transported by the screw rollers 5 and 6 and returned to the stirring roller 4 in the developing chamber. For this purpose, the distance (m) between the screw roller 6 and the stirring roller 4 is set to a specified suitable value as shown in FIG. 10. The screw roller 6 and the stirring roller 4 is disposed opposite to each other through the return ports 13.

A distance (m) between each vane periphery of the screw roller 6 and each vane periphery of the stirring roller 4 is set to a suitable value. If the distance is too large, the developing agent being transported by the screw roller 4 mainly falls by gravity from the stirring chamber into the developing chamber. Namely, the developing agent is transported by the screw roller 6 and transferred into the developing chamber, wherein it is merely transferred by the stirring roller 6 to the bottom portion of the developing tank 2. The ability of the stirring roller 4 for transporting the developing agent received from the stirring chamber is decreased. Consequently, the developing agent falling by gravity from the screw roller 6 gradually accumulates in an area of the distance (m). This makes it difficult to quickly return the developing agent into the developing chamber.

In view of the above, as shown in FIG. 10, the distance (m) is set to a value not larger than ½ of a total of diameter d1 of the screw roller 6 and diameter d2 of the stirring roller 4, i.e., ($m \leqq (d1+d2)/2$). This setting enables the stirring roller 4 to immediately catch the developing agent falling by gravity from the screw roller 6, and transport it with stirring to the bottom of the developing tank 2. Therefore, the developing agent moves by gravity and by the rotation of the stirring roller 4. Namely, the developing agent falling by gravity does not accumulate and it can be immediately transferred by the stirring roller 4. In consequence, the transporting capacity of the system including the screw roller 6 and the stirring roller 4 is so increased that the developing agent can be quickly returned into the developing chamber wherein it is stirred by the stirring roller 4 for a subsequent developing process.

(Embodiment 4)

In the above described embodiments, a developing agent is returned through the return ports 13 to the stirring roller 4. The developing agent contains carriers and is apt to fall downward by gravity. Therefore, a large amount of developing agent may accumulate in the lower developing chamber.

As shown in FIG. 3, the developing device has a developing tank (housing) which is horizontally divided into an upper stirring chamber and a lower developing chamber. Therefore, developing agent transported first from the lower developing chamber into the upper stirring chamber through an inlet opening 9 and then returned into the lower developing chamber through return ports 13. In this construction, it may be sought that a return of developing agent by gravity into the lower developing chamber through return ports 13 is larger than a feed of the developing agent into the upper stirring chamber through the inlet opening 9.

Consequently, the developing chamber may become full of developing agent, causing problems such as insufficient stirring by the stirring roller 4, clogging of passages, increasing of driving torque for the sleeve 3*a* or the stirring roller 4, overheating of the sleeve 3*a* and so on.

In the upper stirring chamber, there may occur insufficient mixing and stirring of newly supplied toner with the developing agent to be transported and returned. This may cause unstable toner concentration of developing agent to be applied.

A developing agent rejected by the regulating member 7 is fed into the upper stirring chamber through the inlet opening 9. The excessive amount of the developing agent in the lower developing chamber makes it difficult to smoothly feed the developing agent into the upper stirring chamber through the inlet opening 9 due to a reduction of a pressure absorbing space therein. Consequently, the developing agent may remain in the developing chamber, causing the above-mentioned troubles and problems.

In the developing device 1, a flow of the developing agent becomes unstable, so the developer roller 3 cannot maintain constant supply of the developing agent to the light-sensitive drum 31, causing unstable developing processes. When a developing process is not being performed, no circulation of the developing agent occurs, therefore, developing agent is packed under the pressure of the regulating member 7 and passages may be clogged with the developing agent. In this case, the circulation of developing agent for a subsequent developing process may not be realized. No developing process can therefore be conducted.

Thus unbalanced circulation of developing agent through the inlet opening 9 and the return ports 13 with an increased return through the latter may cause the above-described problems. A possible solution is to widen the inlet opening 9 to pass more developing agent. However, the large inlet opening 9 may cause decrease the feed of the developing agent therethrough into the stirring chamber due to falling of particles by gravity. This may also cause plugging of the developing agent thereat.

It is also sought to reduce the size of the return ports 13 to save the amount of developing agent into the developing chamber. The constant feed and return of developing agent through the inlet opening 9 and the return ports 13, respectively, can be maintained. In other words, the feed and return of the developing agent can be realized by reducing the size of the return ports 13 since the developing agent is apt to fall by gravity. This solution can thus eliminate the cause of the above-mentioned problems and realize stable circulation of the developing agent, assuring a stable developing process.

However, the return ports 13 may be clogged with the developing agent if they are excessively reduced in size. Therefore, it is necessary to adaptably control the size of the return ports 13 on the basis of practical supply and circulation of the developing agent, thereby assuring the balance between the feed and the return. The solution is for example the provision of each return port with a shutter movably attached thereto to adjust the opening area of the port for controlling the passing amount of developing agent therethrough.

The balance between a feed flow and a return flow of developing agent can be achieved by adjusting the width of the inlet opening 9 and the width of the return ports 13, preventing the excessive return of the developing agent in the developing chamber. An insufficient feed flow of developing agent to the developer roller 3 can be also avoided. It is, however, difficult to suitably adjust the openings of the inlet opening 9 and the return ports 13.

The equivalence between the feed and the return of developing agent can be realized by a simple construction of the developing device which will be described below in detail as the fourth embodiment of the present invention.

In the developing device of FIG. 3, a return port 13 is formed to have vertical inside walls parallel with the falling direction of developing agent. On the contrary, the fourth embodiment of FIG. 12 has a return port 13*a* having a sloped inside wall on one side for regulating a return flow of the developing agent in order to reduce the quantity of particles falling therethrough. Namely, the developing agent slides down along the slope of the return port and is returned onto the stirring roller 4 in the developing chamber. The return of the developing agent can be thus regulated.

Furthermore, a return regulating plate 17 is secured at one end to the sloped wall of the return port 13 and has a free end positioned near the stirring roller 4 in the developing chamber with the return regulating plate 17.

The return regulating plate 17 secured to the return port 13*a* is made of elastic material such as polyethylene terephthalate resin or nonmagnetic metal material such as aluminum and copper. It must be nonmagnetic, otherwise, may be magnetized by the magnetic field of the magnet roller 3*b* and may catch developing agent, preventing the fluidability of particles thereat.

In the developing device 1 of FIG. 12 which is the fourth embodiment of the present invention, a developing agent is supplied and circulates therein as follows:

The developing agent stored in a developing tank 2 of the developing device 1 is supplied by a stirring roller 4 to a developer roller 3. The developing agent is magnetically adsorbed to the surface of a rotating sleeve 3*a* by the magnet roller 3*b* positioned inside the sleeve 3*a* and transported to a regulating member 17. A part of the developing agent passes through a regulated gap between the rotating sleeve 3*a* of the developer roller 3 and the tip of the regulating member 7 and transferred onto a light-sensitive drum 31 disposed opposite to the developer roller 3.

Figure 12:
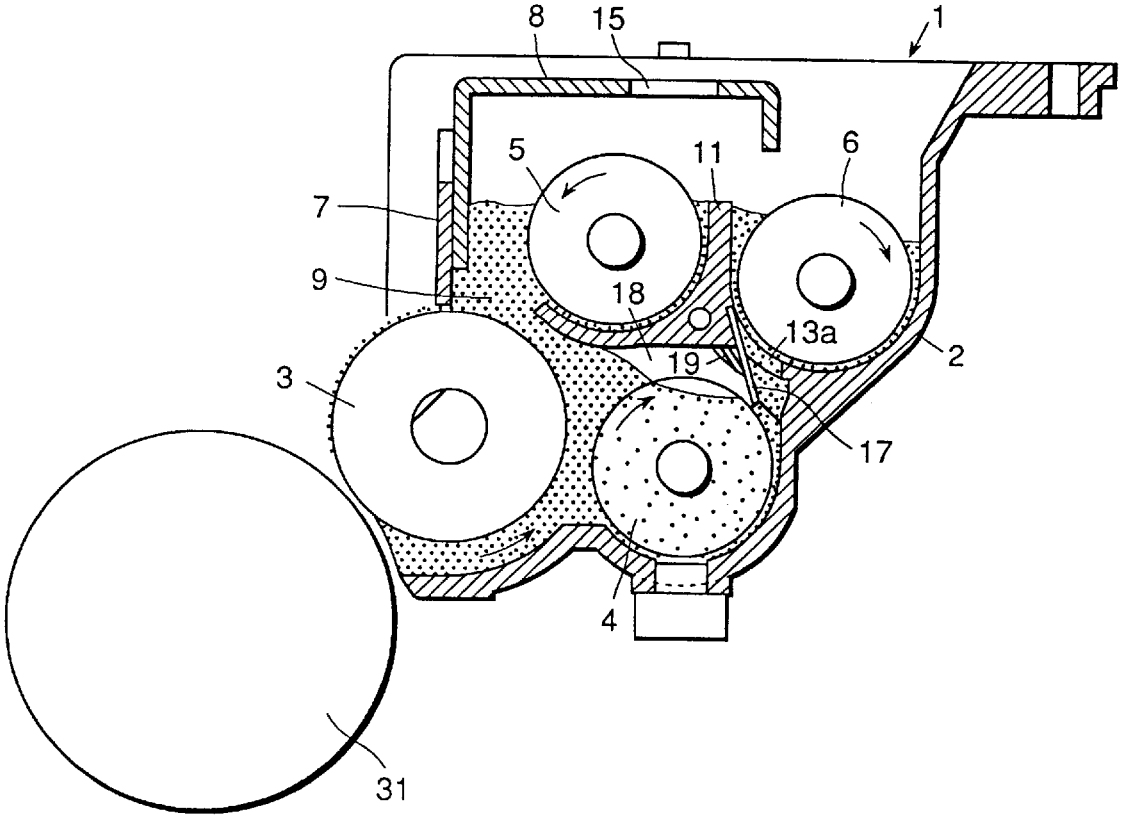
FIG. 12 is a view for explaining the construction of a developing device according to the fourth embodiment of the present invention, which is made for improving circulation and stirring of developing agent in the device.

A developing agent having not passed under the regulating member 7 is pushed upward by the successively transported developing agent and enters through an inlet opening 9 into the upper stirring chamber wherein the developing agent is stirred and transported by a first screw roller 5 in the direction from this side to the other side as seen in FIG. 12. The developing agent is transported by the first screw roller 5 and transferred to a second screw roller 6 through a passage hole 12*a* (FIG. 4) made in the other end portion of a baffle plate 11. A part of the developing agent is also transferred to the second screw roller 6 through a center passage hole 12*c* (FIG. 4) made in the center of the baffle plate 11.

The developing agent transferred to the second screw roller 6 is further transported, while being stirred, in the reverse direction. As the developing agent is transported it is gradually returned into the developing chamber through a return port 13*a* communicating with the inside the developing chamber. In this instance, the developing agent is returned being regulated by a regulating plate 17 in the return port 13*a* to the reverse side of the stirring roller 4 opposite to the developer roller 3.

A developing agent not having been returned into the developing chamber through the return port 13*a* is transferred again to the first screw roller 5 through the passage hole 12*b* made in this side end-portion of the baffle plate 11, and then transported together with developing agent supplied through the inlet opening while being stirred simultaneously in the backward direction. Thus, the developing agent is circulated while being stirred between the stirring chamber and the developing chamber until it is used for developing processes.

The developing agent having passed through a gap under the tip of the regulating member 7, is further transported by the rotating developer roller 3 and transferred therefrom onto the light-sensitive drum 31 disposed opposite thereto at the developing position. A latent electrostatic image formed on the light-sensitive drum 31 is developed with toner in the developing agent. After this, the developer roller 3 rotates to collect the developing agent remaining thereon into the developing chamber. The developing agent falls off the developer roller 3 at a position where the magnet roller 3 cannot attract toner particles. The stirring roller 4 disposed opposite to the developer roller 3 mixes the collected developing agent with the developing agent returned from the stirring chamber and transports the mixture toward the developer roller 3.

As described above, the developing agent to be returned from the stirring chamber through the return port 13*a* is regulated by the return regulating plate 17. In this case, the tip of the return regulating plate 17 is positioned on the near side of the stirring roller 4 which is opposite at the other side of the developer roller 3, so the developing agent returned through the return port is stirred and transferred by the stirring roller 4 to the developer roller 3. Therefore, a large amount of the developing agent is returned from the stirring chamber into the developing chamber.

In the developing device of FIG. 3, a part of the returned developing agent may be transferred directly to the developer roller 3 over the stirring roller 4. In the developing device of FIG. 12, a developing agent is returned along the return regulating plate only to the stirring roller 4. Therefore, a vacant space 18 is left over the stirring roller 4 in the developing chamber.

The amount of the developing agent to be returned through the return port 13*a* is thus regulated, thereby the amount of the developing agent to be stirred and transported by the stirring roller 4 is always kept at a constant level. Consequently, the amount of the developing agent to be stirred and transported by the first and second screw rollers 5 and 6 is stabilized. The developing agent can be well stirred and smoothly transported. Namely, the developing agent smoothly circulates and is surely supplied to the developer roller 3. In the developing chamber, a vacant space 18 is formed over the stirring roller 4 not to increase the driving torque of the stirring roller 4. The above-described stress applied to the developing agent in the developing chamber can be also eliminated.

In the developing device 1 of FIG. 3, there may not be formed a vacant space as seen in FIG. 12 when a large amount of the developing agent has been returned to the stirring roller 4 from the upper stirring chamber through the return port 13. Consequently, the developing agent may not smoothly be supplied and may circulate with an unstable flow rate. The developing agent may suffer stresses thereto. On the contrary, the developing device of FIG. 12 can regulate and stabilize the return of the developing agent, eliminating the above described problem.

Figure 13:
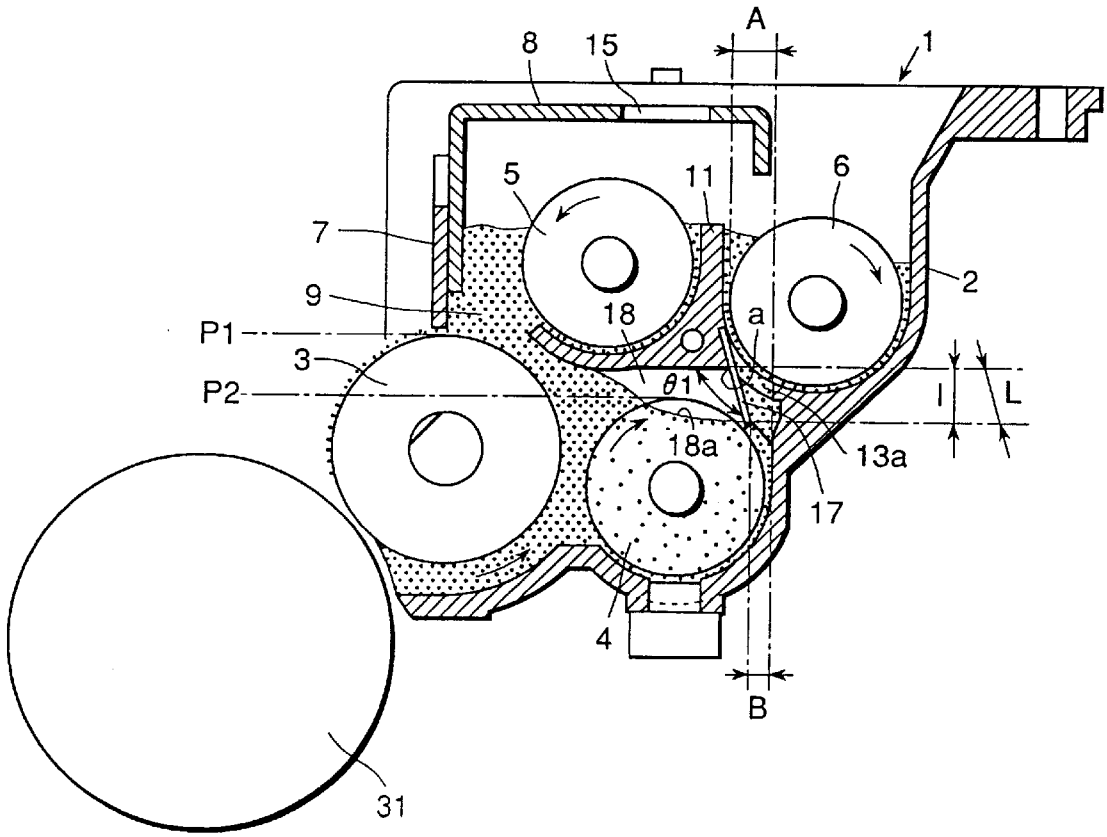
FIG. 13 is a view for explaining a developing device which is the fourth embodiment of the present invention.

As shown in FIG. 13, a vacant space 18 formed above the stirring roller 4 in the developing chamber is determined by the return regulating plate 17. Namely, the level 18*a* of the developing agent in the developing chamber is determined by the position of the tip of the regulating plate 17. As described before, the developing agent is returned always to the stirring roller 4 by which it is stirred and supplied to the developer roller 3. Therefore, the level of the developing agent in the vacant space 18 in the developing chamber is determined by the position of the tip of the return regulating plate 17. The return flow of the developing agent into the developing chamber can be regulated (controlled) so as not to cause the excessive return of the developing agent therein.

The stirring roller 4 can always protrude its upper body portion in the vacant space 18 when the tip of the regulating plate 17 is preset lower than the top position (upper dead point) P of the stirring roller 4. The level of the returned developing agent in the developing chamber can be always kept lower than the top surface of the stirring roller 4.

As shown in FIG. 13, the return regulating plate 17 secured to the sloped inside wall of the return port 13*a* has a free end starting at the point "a" and positioned at a level lower than the uppermost level (development starting point) P1 of the developer roller 3 (sleeve 3*a*). If the free end stating point "a" of the return regulating plate 17 is at a level higher than the point P1, an amount of the developing agent to be supplied to the developer roller 3 is reduced. Insufficient feed of the developing agent to the developer roller 3 may occur. The developing agent cannot smoothly circulate. Namely, the developing agent is less transferred from the developing chamber to the upper stirring chamber and less returned from the stirring chamber into the developing chamber. The developing agent may partly accumulate in the route.

The above-mentioned problem can be solved by the free-end stating point "a" of the return regulating plate 17 which is located lower than the uppermost level P1 of the developer roller 3. The developing agent can be effectively transferred and circulated.

As described above, the return of developing agent can be controlled by positioning the free-end tip of the return regulating plate 17 lower than the uppermost level P2 of the stirring roller 4. The returned developing agent can effectively be fed and circulated. If the tip of the return regulating plate is at a level higher than the uppermost point P2 of the stirring roller 4, an amount of the developing agent to be returned into the developing chamber cannot be regulated, causing reduction of the vacant space 18 (FIG. 12) therein. The stirring roller 4 cannot efficiently stir the developing agent in the developing chamber. Therefore, the tip of the return regulating plate 17 is placed as shown in FIG. 13.

The return regulating plate 17 is disposed on the nearest side of the stirring roller 4 that opposes at the other side to the developer roller 3 in the developing tank 2. The developing agent returned into the developing chamber through the return port 13*a* always falls on the side surface of the stirring roller, not directly be transferred to the developer roller 3 over the stirring roller 4. The developing agent can thus flow normally along the circulating route in the developing device, which not being disturbed and obstructed midway.

The tip of the return regulating plate 17 is placed in the tangential direction of the circumference of rotating vanes 4*a* of the stirring roller 4, shown for example in FIG. 5, in order to improve the circulating and transferring conditions for agent. The developing agent returned through the return port 13*a* can be immediately transported by the rotating vanes 4*a* of the stirring roller 4. Namely, the developing agent is returned through the return port 13*a* in a controlled state and falls into a space between the inside wall of the developing tank and the rotating stirring roller 4, wherefrom it is immediately transported being stirred by the vanes of the stirring roller 4 rotating in the direction indicated by an arrow in FIG. 3, and further supplied to the developer roller 3. Thus, the returned developing agent is smoothly transported without delay by the stirring roller 4 to the developer roller side. The return flow of the developing agent can be normally controlled not to cause lack of the returned developing agent in the developing tank.

The return regulating plate 17 made of elastic material such as plastic resin or metal can elastically warp toward the developer roller side to allow a suddenly or temporarily increased amount of the developing agent to return into the developing chamber through the return port 13*a*. This restores a smooth flow of the developing agent circulating in the developing device. A thin resin-made return-regulating plate 17 may be provided at its back side with a suitable reinforcing member 19 (FIG. 12) to prevent the regulating plate from warping over the limit at which it loses its elasticity. If the plate is permanently deformed, developing agent may directly get over the stirring roller 4 and fall to the developer roller side. A metal-made return-regulating plate does not require such reinforcing member 19.

The shown return regulating plate 17 is secured to an inside open edge of the return port 13. However, the return regulating plate 17 is not limited to the shown example and may have another construction if it can regulate an amount of the developing agent flowing into the developing chamber through the return port 13. For example, the return regulating plate 17 can be secured at its one end to the bottom wall of the partition member 2*a* in such a way that its free end is located in a space between the stirring roller 4 and the inside wall of the developing tank 2. The return regulating plate 17 may be integrally formed with the partition member 2*a*.

The shown return regulating plate 17 has a flat surface. However, it may have a shaped surface having, e.g., a large number of random projections formed thereon for regulating a flow of developing agent and/or it may be provided with ribs sloping in different directions. The shaped return-regulating plate can regulate an amount of the developing agent flowing thereon and simultaneously stir it by the projections and/or the ribs, thus improving the stirring ability of the developing device.

The developing device that is the fourth embodiment of the present invention was tested for ascertaining its excellent performance as to the stirring ability in particular in comparison with that of the developing device of FIG. 3. The obtained results will be described below as an aspect of the present invention.

As seen in FIG. 13, a return port 13*a* for returning a developing agent from the stirring chamber into the developing chamber has an open width A of 4.6 mm and is provided with a return regulating plate 17 secured at it one end thereto and protruding its free end by length L of 6 mm. In this instance, the return regulating plate 17 is sloping at an angler θ1 of 107°. A horizontal distance B between the tip of the return regulating plate 17 and the open edge of the return port whereto nothing is secured is set to 2.7 mm. The protrusion length L of the return regulating plate 17 has a vertical distance 1 of 5.6 mm.

The return regulating plate 17 made of polyethylene terephthalate resin was used.

In the above described developing device, the developing agent was circulated by rotating of the stirring roller 4 and the developer roller 3 in the developing chamber and the first and second screw rollers 5 and 6 in the stirring chamber. Driving torque of the stirring roller 4 was measured in the developing chamber. A change of the driving torque (kgfcm) of the stirring roller was measured by gradually increasing the amount of developing agent in the developing tank 2. The obtained results are shown in FIG. 14.

Figure 14:
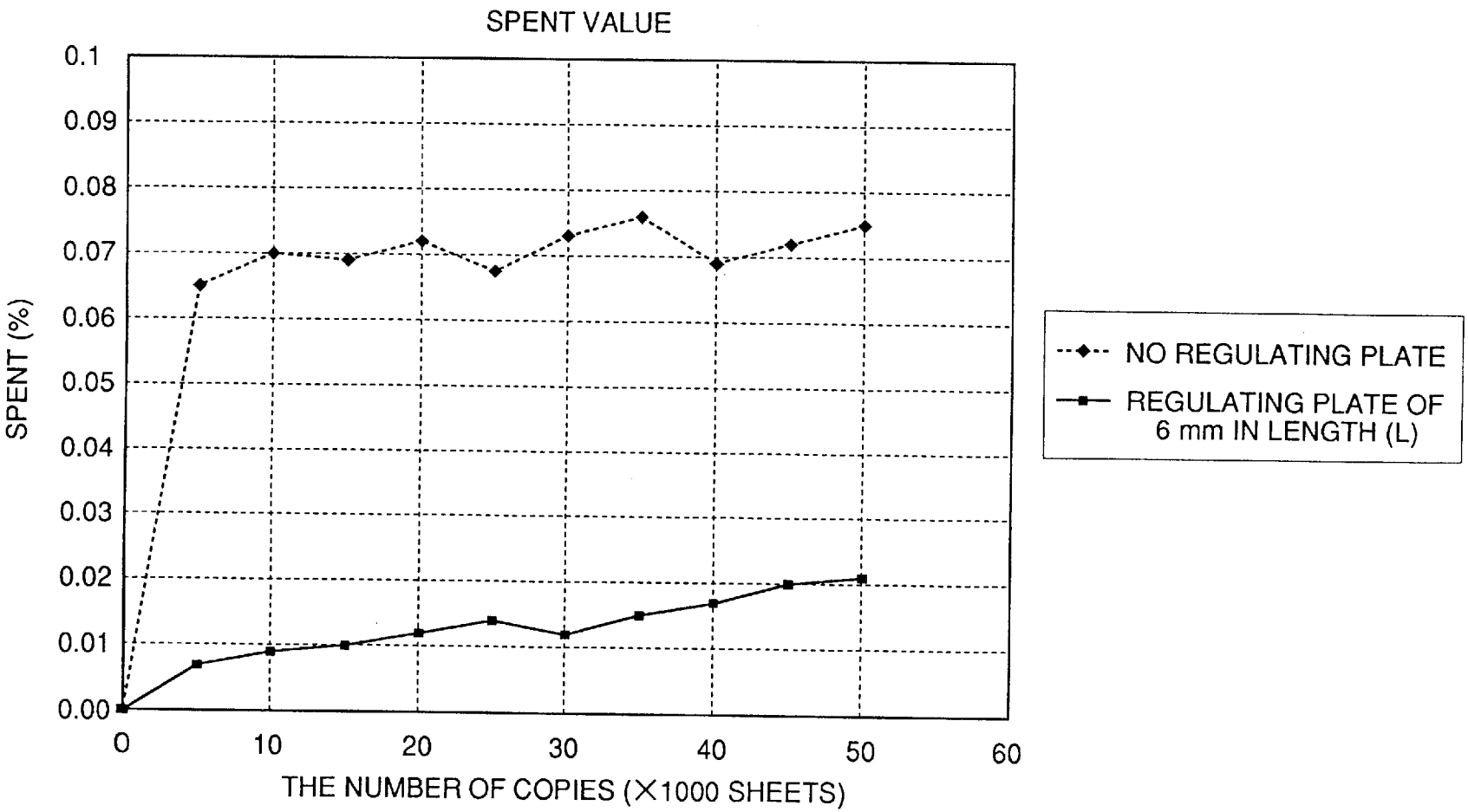
FIG. 14 is a graph showing the relation between developing agent amount and stirring torque in the developing device of the fourth embodiment in comparison with that in the first embodiment of the present invention.

In the developing device provided with the return regulating plate 17, a large change of the driving torque of the stirring roller 4 with an increased amount of the developing agent could not be observed (see FIG. 14). In the developing device of FIG. 3, the same measurements were conducted. It was confirmed that driving torque of the stirring roller 4 gradually increased as the amount of developing agent increases in the developing tank. The developing device of FIG. 3, however, does not have such an increased accumulation of the developing agent in the developing chamber in the practical developing process and therefore does not require increasing driving torque of the stirring roller. The unbalance (difference) between the loads of the developing agent in the stirring chamber and the developing chamber can be reduced by suitably setting sizes of the inlet opening 9 and the return port 13. Therefore, the developing device of FIG. 3 can be used with no trouble for practical use in an image-forming apparatuses.

The provision of the return regulating plate 17 can minimize a change in driving torque with an increase in the amount of developing agent and can control the return of the developing agent into the developing chamber so as to maintain a normal level of the developing agent therein. The stress applied to the developing agent can also be minimized.

With no change in driving torque of the stirring roller, it is possible to maintain a necessary suitable level of the developing agent in the developing chamber, avoiding the excessive or insufficient supply of the agent. The developing agent can be smoothly transported in the circulating route in the developing device and stably supplied to the developing processes.

Figure 15:
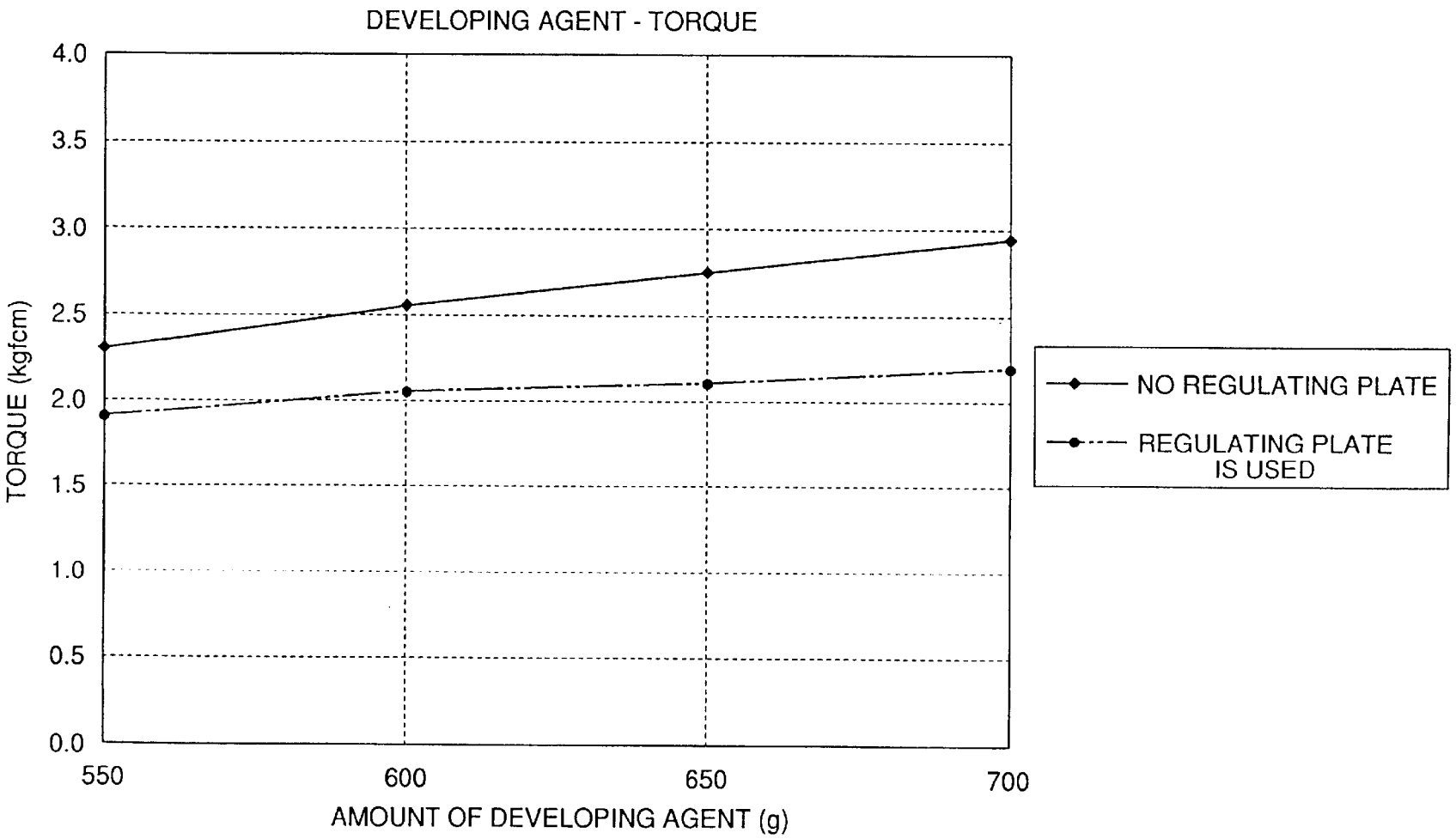
FIG. 15 is a graph showing the relation between the number of copies and consumption of developing agent in the developing device of the fourth embodiment in comparison with that in the first embodiment of the present invention.

FIG. 15 shows the results of experiments on change in a spent value of the developing agent, which was caused by stirring. The spent values were measured in the developing device of FIG. 12 (the fourth embodiment with the return regulating plate) and the developing device of FIG. 3 (the first embodiment without the return-regulating plate). The spent value (%) represents a change in electrical charge of toner particles due to deterioration of carrier composing the developing agent, as the result of toner fused onto the carrier after a repeated use for a long time. In the other words, carrier particles gradually deteriorate (aged) with toner particles fused thereto, accompanied by a gradual decrease of electrical charge of the toner particles. The electrical charge of the toner is considerably reduced if the developing agent is not stirred sufficiently and/or is given increasing stress.

As is apparent from the teat results shown in FIG. 15, the provision of the return regulating plate 17 makes it possible to control an amount of the developing agent to be returned to the stirring roller 4 that in turn can effectively stir the returned developing agent, preventing the increase of a spent value of the developing agent. In the developing device of FIG. 3, which is not provided with the return regulating plate 17, the spent value gradually increases until the ten thousand copies are produced, but it scarcely changes after that. This fact indicates that the developing agent does not suffer excessive stress in the development device of FIG. 3.

Figure 16:
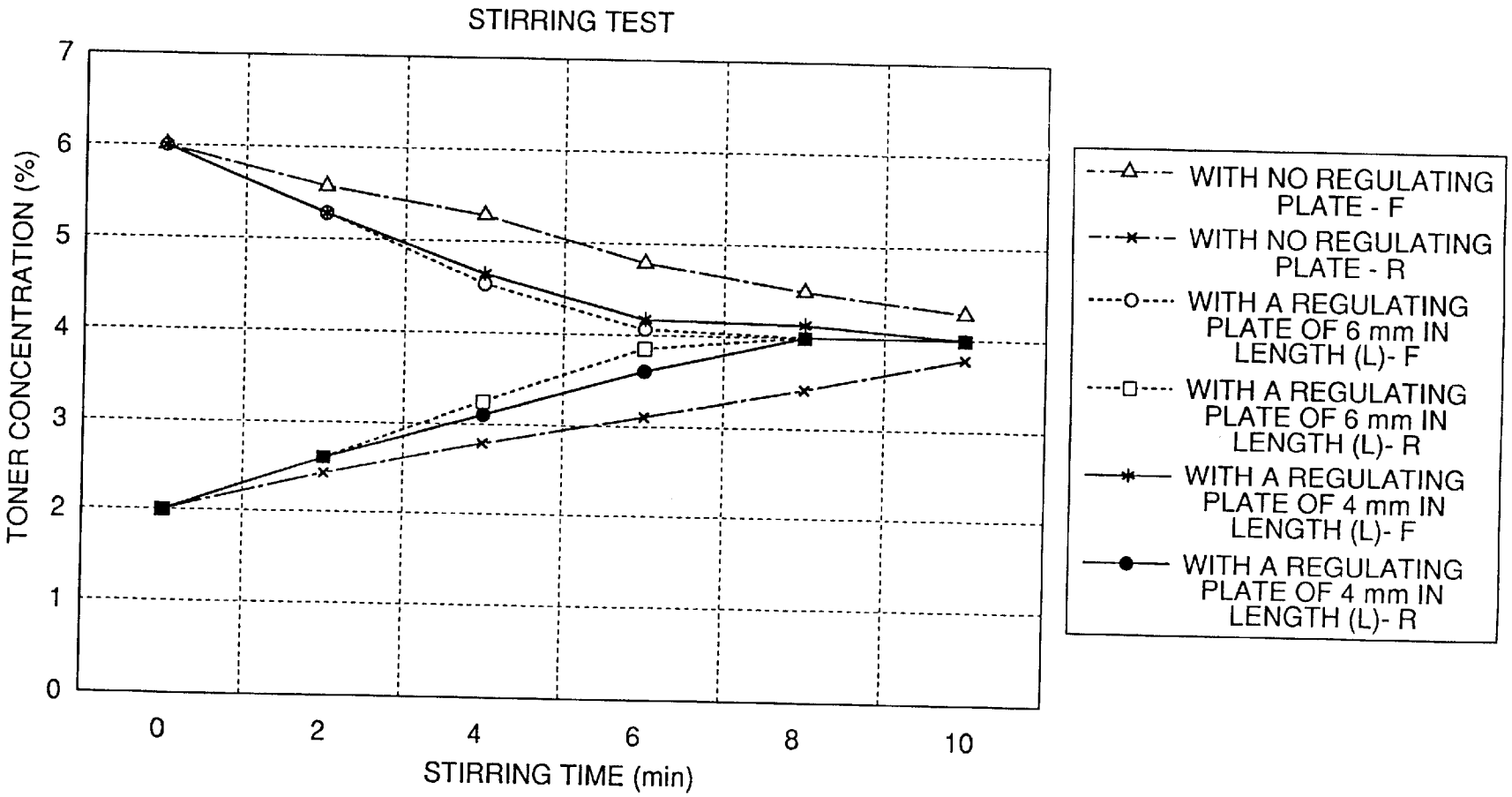
FIG. 16 is a graph showing the comparison of developing agent stirring performances of developing devices according to the fourth and first embodiments of the present invention.

Furthermore, the stirring ability of the developing device provided with the return regulating plate was examined by measuring a change in the toner concentration of the developing agent with a supply of toner. In this case, the toner was supplied from the front (F) of the developing device 1 (FIG. 4) and the toner concentration of the developing agent was measured at the supply point and at a rear side (R) of the developing device, respectively, to check how the toner concentration changed. FIG. 16 is a graph showing the measurement results obtained in the development device of FIG. 13 (the fourth embodiment) with return regulating plates 17 of 6 mm and 4 mm in length (of its protrusion) and in the developing device of FIG. 3 (the first embodiment with no return-regulating plate).

As seen in FIG. 16, a better toner stirring ability of the device was obtained with the return regulating plate having a longer protrusion L. This is because a level of the top surface 18*a* of developing agent in the vacant space 18 in the developing chamber drops, improving thereby stirring condition of the developing agent. Namely, the first and second screw rollers 5 and 6 in the upper stirring chamber can also work with a sufficient supply of the developing agent and can effectively stir and transport it.

The developing device with no return-regulating plate 17 (the first embodiment) is inferior in the toner stirring ability that the developing device having the return regulating plate 17, but possesses a necessary toner-stirring ability for realizing stable developing processes. The provision of the return regulating plate 17 is, of course, preferable for further improving the stirring ability of the device.

The fourth embodiment is provided with the return regulating plate 17 for regulating an amount of the developing agent to be returned into the developing chamber so as to always maintain a necessary level of the developing agent therein. The provision of the return regulating plate 17 can offer the above described advantageous effects.

In the shown embodiment, the return regulating plate 17 is used in an inclined state. It is also possible to fix the return regulating plate 17 in the vertical state with its tip located on the right-hand side and at a level lower than the uppermost position (upper dead point) (P2) of the stirring roller 4 (as shown in FIG. 12). Thus, the vacant space 18 can be formed. However, this vertical return-regulating plate is less effective to regulate a flow of the developing agent.

The inclined return regulating plate 17 can exercise a full effect of regulating a return of developing agent through the return port. The angle θ 1 (FIG. 12) of inclination of the return regulating plate 17 shall be over 90° and preferably not less than 95°. A desirable inclination angle of the plate 17 is 100° or more. The upper limit is 125° since the too large inclination may cause the shortage of developing agent returned in the developing chamber. The desirable inclination angle θ 1 is 120°.

The inclination angle θ 1 is determined by the position of the return port 13*a* and the position of the tip of the return regulating plate 17. Accordingly, the position of the return port 13*a* and the protrusion length L of the return regulating plate 17 shall be adequately set to meet the above described requirements.

As described before as to the embodiments 1 to 4 and an example of the developing device for explaining the effects of the fourth embodiment is the developing chamber, the developing device 1 has the two-stage developing tank 2 containing therein the developing roller 4, wherein a toner supply area is provided in the upper portion thereof and a developing agent regulated by the regulating member 7 is fed into the toner supply area. This makes the developing device compact with a reduced width in the horizontal direction and enables the device to sufficiently mix and stir the regulated developing agent with newly added toner and then supplied again for developing process. Accordingly, the application of the developing device enables an image-forming apparatus to produce high-quality copy products by developing a latent image with developing agent mixed with fresh toner and sufficiently stirred developing agent and can also realize a very compact image-forming apparatus, e.g., a tandem-type color-image forming apparatus.

In a conventional developing device, a developing agent rejected by a regulating member is directly returned to a stirring roller. To mix fresh toner with the developing agent, it is necessary to stop the developing process, sufficiently stir the developing agent and then restart the developing process or to use a plurality of stirring rollers to increase the stirring capacity. The former method decreases the developing speed and the latter increases the size of the developing device.

The developing device 1 according to the present invention contains only one stirring roller 4 but uses the screw rollers 5 and 6 disposed in the upper area (above the stirring roller 4) for stirring developing agent, mixing supplied toner with the developing agent and stirring the mixture. This enables the developing device to conduct developing process at a high speed and does not require increasing the sizes of the developing device. The developing device is adapted to use in a high-speed image-forming device.

In the developing device according to the present invention, the developing agent can be effectively circulated between the lower developing chamber and the upper stirring chamber. The use of the return regulating plate 17 for controlling the developing agent to be returned through the return port into the developing chamber can improve conditions for circulating and stirring the developing agent and, thereby, realizes the stable supply of the developing agent to developing processes.

The screw rollers 5 and 6 (FIG. 4) disposed in the stirring chamber are intended to transport developing agent in its axial direction with stirring simultaneously. Therefore, they may be of the stirring roller type as shown in FIG. 5. In this case, the screw rollers 5 and 6 are the stirring means with removed feeding elements 4*d*.

The developing device of the present invention is capable of effectively stirring the developing agent and mixing the developing agent with newly added toner and stirring the mixture. The developing device is very compact and may contribute the reduction in sizes of an image-forming apparatus.

The developing device is particularly adapted to use in a tandem type color image forming apparatuses which are keenly required to be reduced in size.

The developing device can be also adapted for a high-speed developing process. It is very compact and can be used for wide application.

Furthermore, the developing device is provided with a return regulating plate which improves the conditions of circulating and stirring of the developing agent, realizing the stable developing process. The developing agent can be kept at a suitable level and, thereby, eliminates the possibility of increasing the driving torque for stirring the developing agent.

The invention being thus described, it will obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing device, comprising a developing tank containing a developer roller for transferring by electrically adsorbing thereto a developing agent consisting of toner particles and carrier particles, wherein the developing tank is horizontally divided by a partition member into two areas, the lower area is a developing chamber containing the developer roller and the upper area is a stirring chamber containing a first and second transporting means separated by a baffle for stirring and transporting the developing agent therein, said baffle having passage holes formed therein, said stirring chamber has an inlet opening for introducing therein the developing agent regulated by a regulating member, said opening is formed between an end of the partition member and an end of the regulating member for limiting an amount of developing agent to be adsorbed by the developing roller, and the partition member has at least one port formed therein for circularly returning the developing agent from the upper stirring chamber into the lower developing chamber.

2. A developing device as defined in claim 1, wherein the upper stirring chamber has in its one end a toner supply port for allowing therein compensatory toner particles to be mixed with the developing agent regulated and fed therein by the regulating member and contains the first transporting means for mixing a toner with the developing agent and transporting, with stirring at the same time, the developing agent from its one end positioned at the toner supply port side to the opposite end and the second transporting means for transporting, with stirring, the developing agent in the reverse direction, both the transporting means are disposed in parallel with each other, wherein said baffle plate having the passage holes formed therein allows circulation of the developing agent between the first and second transporting means.

3. A developing device as defined in claim 2, wherein the baffle plate has the passage holes made by ones in both end portions and a center portion, respectively, of the baffle plate and the second transporting means has corresponding return ports.

4. A developing device as defined in claim 3, wherein a sensor for detecting toner-concentration of the developing agent is disposed on the bottom of the developing tank at a position corresponding to the passage hole made in the center potion of the baffle plate.

5. A developing device as defined in claim 3, wherein a toner loading end of the first transporting means is separated from the second transporting means by a blind portion of the baffle plate, said blind portion having no passage hole.

6. A developing device as defined in claim 2, wherein the first transporting means is disposed on the inlet opening side and the second transporting means is disposed on the at least one port side and possesses transporting capacity larger than that of the first transporting means.

7. A developing device as defined in claim 2, wherein the tip of the partition member is located within an area of angle θ limited between a straight line connecting a center axis of the developer roller with a center axis of the first transporting means and a straight line connecting the center axis of the developer roller with an outer diametrical point of the first transporting means and the inlet opening is formed between the tip of the partition member and the tip of a regulating plate.

8. A developing device as defined in claim 1, wherein the tip of the partition member is disposed corresponding to one of magnetic poles of a magnet roller composing the developer roller.

9. A developing device as defined in claim 1, wherein a stirring means for stirring the developing agent returned thereto through said at least one port and transferring the developing agent to the developer roller in the developing chamber is disposed opposite to said at least one port and at a distance m from the transporting means in the stirring chamber, said distance being set to a value not more than one-half of the sum of diameters of the transporting means and the stirring means.

10. A developing device comprising a developer roller for transferring by electrically adsorbing thereto developing agent consisting of toner particles and carrier particles, wherein a developing chamber containing the developer roller and a stirring roller for stirring and transferring the developing agent to the developer roller is disposed and a stirring chamber containing therein a first and second transporting means for stirring and transporting the developing agent are disposed above the developing chamber, a regulating member for limiting an amount of the developing agent to be applied to the developer roller is disposed opposite to the developer roller, an inlet opening is formed for allowing the developing agent rejected by the regulating member to enter into the stirring chamber, return ports are provided for returning the developing agent stirred in the stirring chamber into the developing chamber and a return regulating plate for limiting an amount of the developing agent to be returned through the return ports and returning the developing agent to the opposite side of the stirring roller opposing the developer roller in the developing chamber, wherein the first transport means mixes a toner with the developing agent and transports the developing agent from its one end positioned at a toner supply port side to an opposite end thereof.

11. A developing device as defined in claim 10, wherein the return regulating plate is mounted with a downward sloping end located at a level not higher than the uppermost position (top dead point) of the stirring roller.

12. A developing device as defined in claim 11, wherein the end of the return regulating plate extends in the tangential direction of the circumference of the rotating stirring roller.

* * * * *